US008322561B2

(12) United States Patent
Ramsey et al.

(10) Patent No.: US 8,322,561 B2
(45) Date of Patent: Dec. 4, 2012

(54) CONTAINER ASSEMBLY HAVING REMOVABLE EXTERIOR SHELF STRUCTURES

(75) Inventors: Brian Ramsey, Bridgeville, PA (US); Henry Hay, Calgary (CA); Leslie Kirby, Moon Township, PA (US)

(73) Assignee: NOVA Chemicals (International) S.A., Fribourg (CH)

( * ) Notice: Subject to any disclaimer, the term of this patent is extended or adjusted under 35 U.S.C. 154(b) by 388 days.

(21) Appl. No.: 12/838,711

(22) Filed: Jul. 19, 2010

(65) Prior Publication Data

US 2011/0036853 A1 Feb. 17, 2011

Related U.S. Application Data

(60) Provisional application No. 61/234,336, filed on Aug. 17, 2009.

(51) Int. Cl.
*B65D 95/00* (2006.01)

(52) U.S. Cl. ..... 220/694; 220/23.4; 220/23.2; 220/826; 220/908

(58) Field of Classification Search ..... 206/503; 220/23.4, 23.86, 23.87, 500, 503, 751, 908; 294/68.1, 68.2; D34/1
See application file for complete search history.

(56) References Cited

U.S. PATENT DOCUMENTS 4,182,530 A * 1/1980 Hodge ..... 294/68.26
4,550,849 A 11/1985 Adsit
4,676,431 A * 6/1987 Teske et al. ..... 232/43.1
4,726,616 A * 2/1988 Schmidt ..... 294/68.2
4,811,660 A 3/1989 Robbins
5,011,036 A * 4/1991 Souza et al. ..... 220/263
5,108,000 A * 4/1992 Stoll et al. ..... 220/23.4
5,183,180 A * 2/1993 Hawkins et al. ..... 294/68.1
5,330,071 A * 7/1994 Parker ..... 220/645
D353,727 S 12/1994 Sun
D359,618 S 6/1995 Chen
5,423,448 A 6/1995 Pedigo
D369,022 S 4/1996 Sun
D370,701 S 6/1996 Thomsen
D371,399 S 7/1996 Pardorf
D414,606 S 10/1999 Sun
5,967,361 A * 10/1999 Darnell ..... 220/623
D421,180 S 2/2000 Sun
6,632,064 B1 10/2003 Walker et al.
(Continued)

*Primary Examiner* — Anthony Stashick
*Assistant Examiner* — Chetan Chandra
(74) *Attorney, Agent, or Firm* — Gary F. Matz

(57) ABSTRACT

A container assembly (1) having a container body (11) and exterior shelf structures (41, 44) that are each reversibly attached to exterior surfaces (35, 38) of first (17) and second (20) sidewalls of the container body (11), is described. Each exterior shelf structure (41, 44) has a shelf base (47), and a forward shelf portion (56) and a rear shelf portion (62) that each extend upwardly from the shelf base (47). Each exterior shelf structure has a shelf space (77) that resides between and is defined in part by the forward (56) and rear (62) shelf portions. The forward shelf portion (56) of each exterior shelf structure (41, 44) has an open front or face (86) that is in communication with a recessed chamber (89) of the forward shelf portion (56). The exterior shelf structures (41, 44) may each be reversibly attached to the container body sidewalls (17, 20) by means of tabs (98) that are received within tab apertures (110) of the sidewalls. The exterior shelf structures (41, 44) may be removed from the container body sidewalls (17, 20) and stored within the container interior (32), allowing the container body to be compactly stored and/or shipped. The container assembly, including the container body and exterior shelf structures, may be used to store items, such as personal items, e.g., toys and/or clothing.

17 Claims, 21 Drawing Sheets

U.S. PATENT DOCUMENTS

| | | | | |
|---|---|---|---|---|
| D506,063 | S | 6/2005 | Hussa-Lietz | |
| D517,265 | S * | 3/2006 | Berres et al. | D34/3 |
| 7,198,166 | B2 * | 4/2007 | Sholinder | 220/4.33 |
| D543,332 | S * | 5/2007 | Taylor | D34/11 |
| 7,234,327 | B2 * | 6/2007 | Howes | 70/159 |
| 7,237,689 | B2 * | 7/2007 | Maggio et al. | 220/675 |
| 7,334,680 | B2 * | 2/2008 | Cunningham et al. | 206/372 |
| D564,168 | S * | 3/2008 | Larin | D34/3 |
| D620,218 | S * | 7/2010 | Larin | D34/1 |
| 7,762,565 | B2 * | 7/2010 | Hatamian et al. | 280/79.5 |
| 8,141,921 | B2 * | 3/2012 | Apps et al. | 294/68.2 |
| 2001/0052522 | A1 * | 12/2001 | Forest | 220/495.07 |
| 2003/0146230 | A1 * | 8/2003 | Eaton et al. | 220/826 |
| 2008/0197645 | A1 * | 8/2008 | Hatamian et al. | 294/68.1 |
| 2009/0179444 | A1 * | 7/2009 | Apps et al. | 294/68.2 |
| 2010/0254796 | A1 * | 10/2010 | Bennett et al. | 414/810 |

* cited by examiner

41

41

CONTAINER ASSEMBLY HAVING REMOVABLE EXTERIOR SHELF STRUCTURES

REFERENCE TO RELATED APPLICATION

This application claims the benefit of priority of U.S. Provisional Application Ser. No. 61/234,336 filed Aug. 17, 2009, entitled "Container Assembly Having Removable Exterior Shelf Structures", which is herein incorporated by reference in its entirety.

FIELD OF THE INVENTION

The present invention relates to container assemblies, that may be used as, for example, bins, such as toy bins and/or clothing bins. More particularly, the present invention relates to container assemblies that include removable exterior shelf structures, that may have the appearance of fork lift pockets.

BACKGROUND OF THE INVENTION

Containers for use in storing items such as toys and/or clothing typically include a body, and a lid structure that is either removable or hingedly attached to the body. The body of the container may further include exterior handles or exterior recesses that allow the container to be manually lifted and moved. See, for example, Des. 359,618 and Des. 421,180.

It would be desirable to design new containers that allow for storage of items both within the container and on the exterior of the container. In addition, it would be desirable that such newly designed containers, may be easily modified so as to allow efficient and compact storage of the container itself.

SUMMARY OF THE INVENTION

In accordance with the present invention, there is provided a container assembly comprising:

(a) a container body comprising, a container base, a first container sidewall, a second container sidewall, a front container wall and a rear container wall, said first container sidewall, said second container sidewall, said front container wall and said rear container wall each extending upwardly from said container base and together defining an open container top and a container interior, said first container sidewall and said second container sidewall being laterally spaced apart and opposed from each other and each having an exterior surface;

(b) a first exterior shelf structure reversibly attached to said exterior surface of said first container sidewall; and (c) a second exterior shelf structure reversibly attached to said exterior surface of said second container sidewall, wherein said first exterior shelf structure and said second exterior shelf structure each comprise, a shelf base having an upper surface, a lower surface, a forward shelf portion having a rear surface, a rear shelf portion having a forward surface, and a shelf inner wall having a first surface and a second surface, said forward shelf portion, said rear shelf portion and said shelf inner wall, each extending upwardly from said shelf base, said forward shelf portion and said rear shelf portion being laterally spaced apart and opposed to each other, said rear surface of said forward shelf portion and said forward surface of said rear shelf portion being in facing opposition to each other, said upper surface of said shelf base, said rear surface of said forward shelf portion, said forward surface of said rear shelf portion and said first surface of said shelf inner wall together defining a shelf space, an open shelf top and an open shelf side, said open shelf top being opposed from said upper surface of said shelf base, and said open shelf side being opposed from said first surface of said shelf inner wall, said forward shelf portion having an open front that is in communication with a recessed chamber of said forward shelf portion, further wherein, at least a portion of said second surface of said shelf inner wall of said first exterior shelf structure, and a portion of said exterior surface of said first container sidewall abutting each other, and at least a portion of said second surface of said shelf inner wall of said second exterior shelf structure, and a portion of said exterior surface of said second container sidewall abutting each other.

The features that characterize the present invention are pointed out with particularity in the claims, which are annexed to and form a part of this disclosure. These and other features of the invention, its operating advantages and the specific objects obtained by its use will be more fully understood from the following detailed description and accompanying drawings in which preferred embodiments of the invention are illustrated and described.

As used herein and in the claims, terms of orientation and position, such as "upper", "lower", "inner", "outer", "right", "left", "vertical", "horizontal", "top", "bottom", and similar terms, are used to describe the invention as oriented in the drawings. Unless otherwise indicated, the use of such terms is not intended to represent a limitation upon the scope of the invention, in that the invention may adopt alternative positions and orientations.

Unless otherwise indicated, all numbers or expressions, such as those expressing structural dimensions, quantities of ingredients, etc., as used in the specification and claims are understood as modified in all instances by the term "about".

BRIEF DESCRIPTION OF THE DRAWINGS

In FIGS. 1 through 21, like reference numerals designate the same components and structural features, unless otherwise indicated.

DETAILED DESCRIPTION OF THE INVENTION

Figure 1:
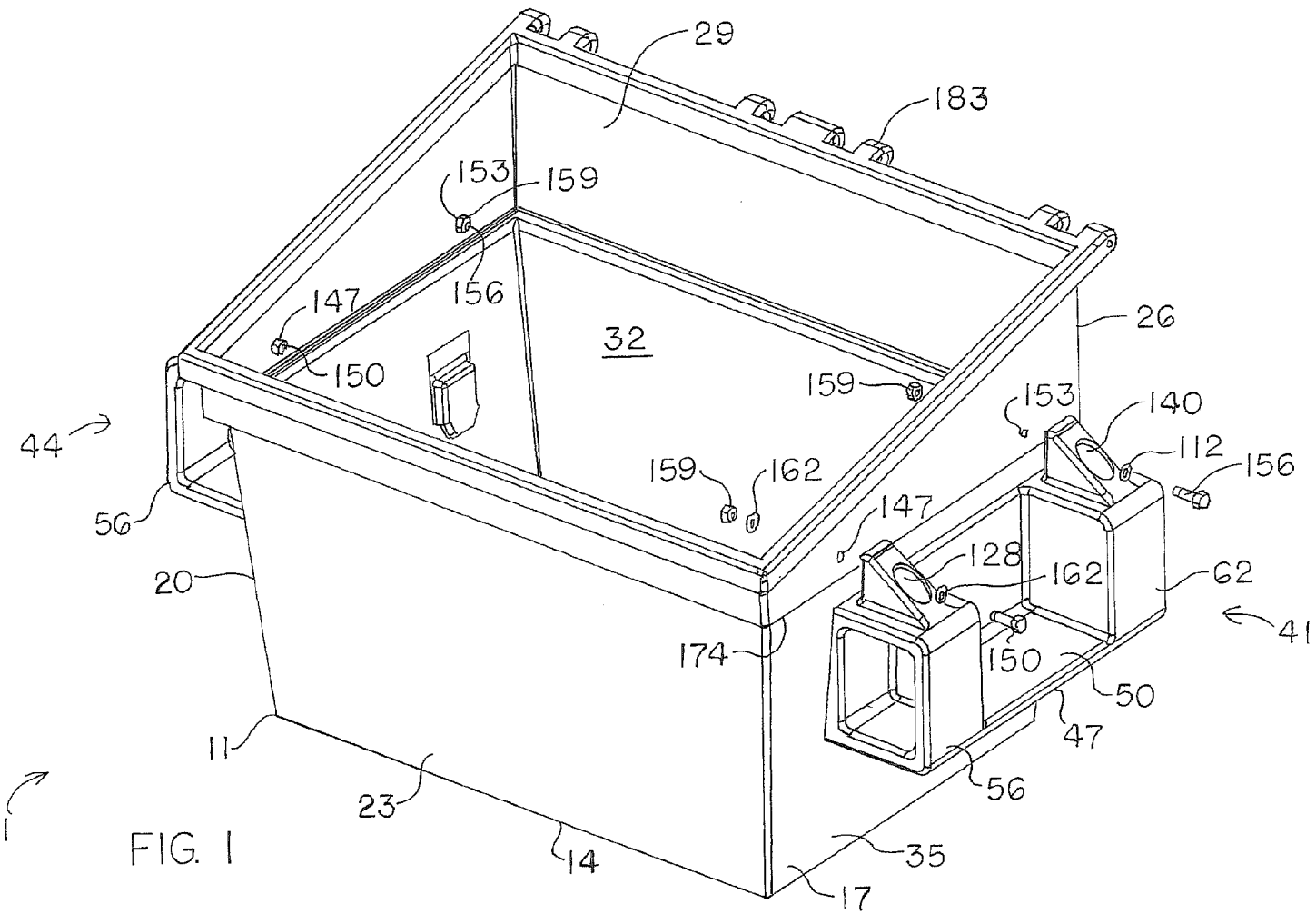
FIG. 1 is a representative partially exploded perspective view of a container assembly according to the present invention.
Figure 2:
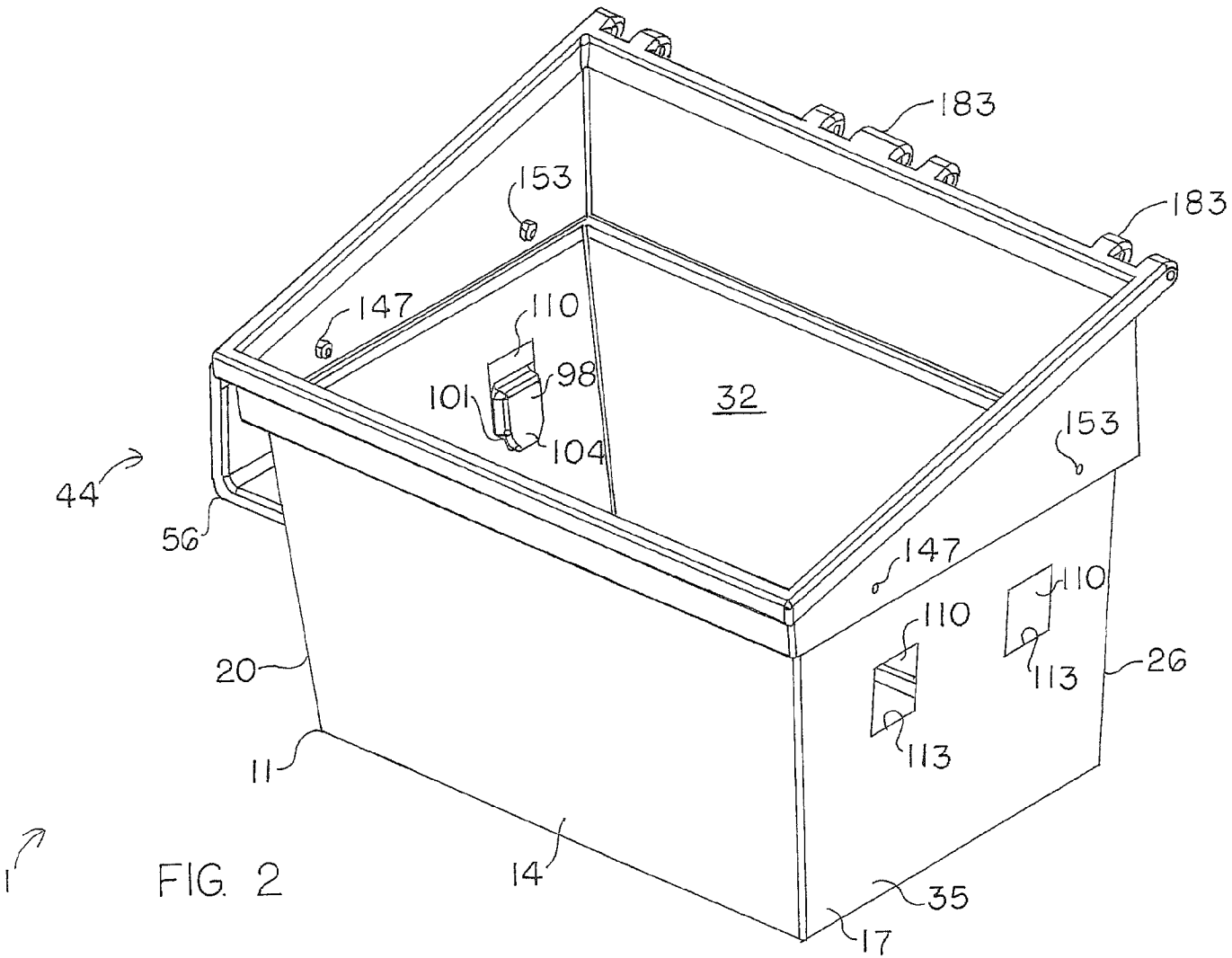
FIG. 2 is a representative perspective view of the container assembly of FIG. 1, without the first exterior shelf structure, showing the tab apertures of the first container sidewall.
Figure 3:
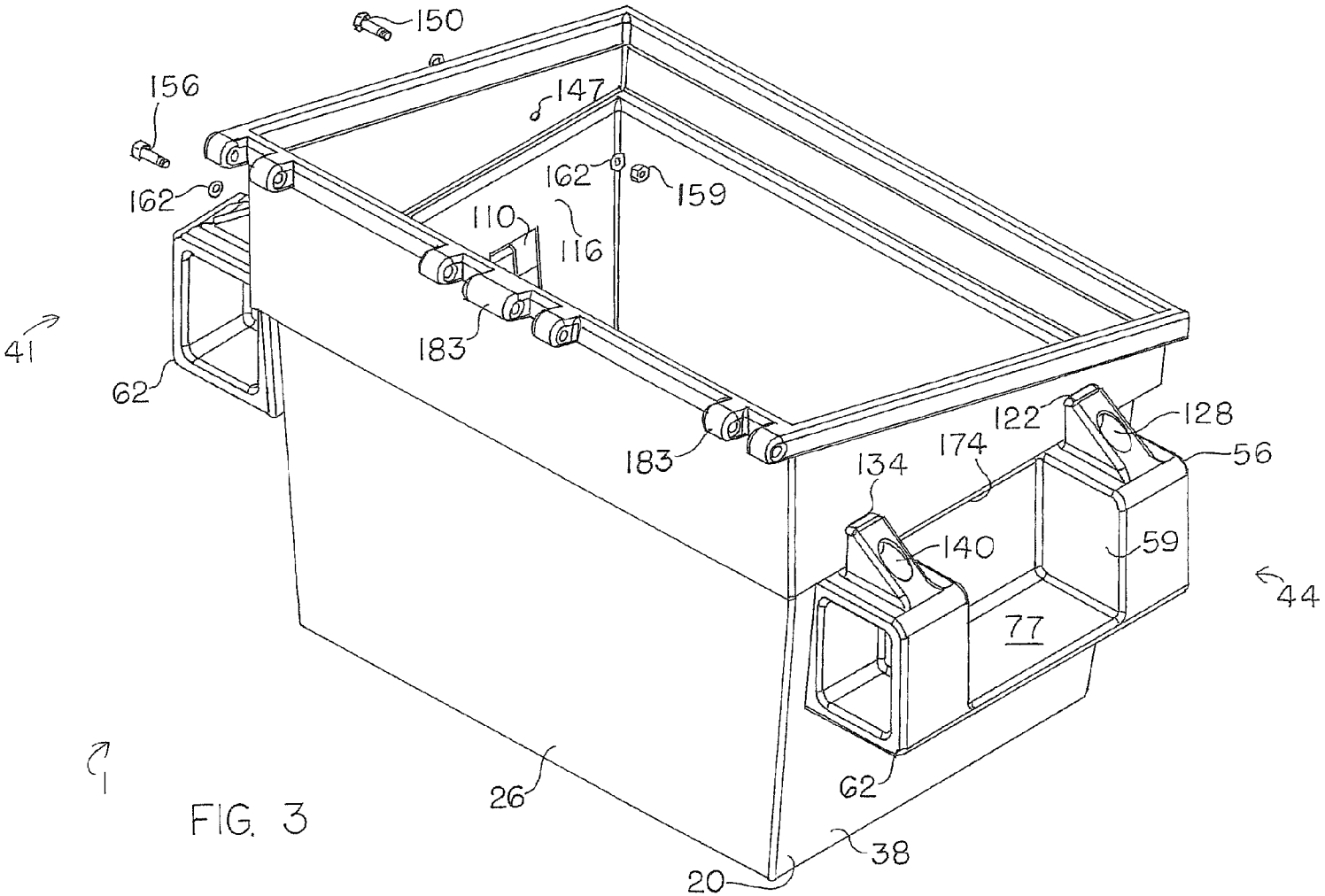
FIG. 3 is a representative partially exploded perspective view towards the rear container wall and the second container sidewall of the container assembly of FIG. 1.
Figure 4:
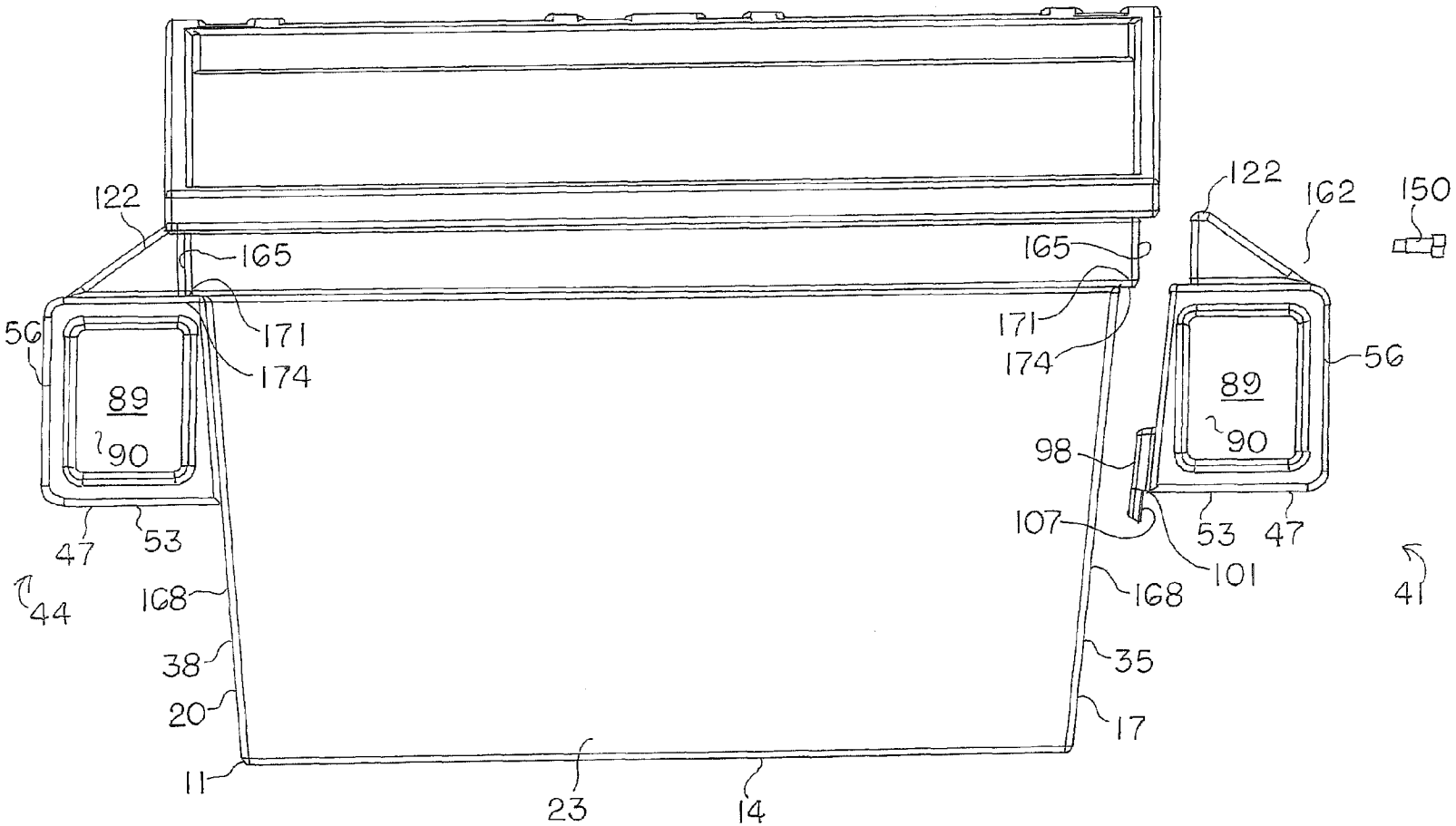
FIG. 4 is a representative partially exploded front elevational view of the front container wall of the container assembly of FIG. 1.
Figure 5:
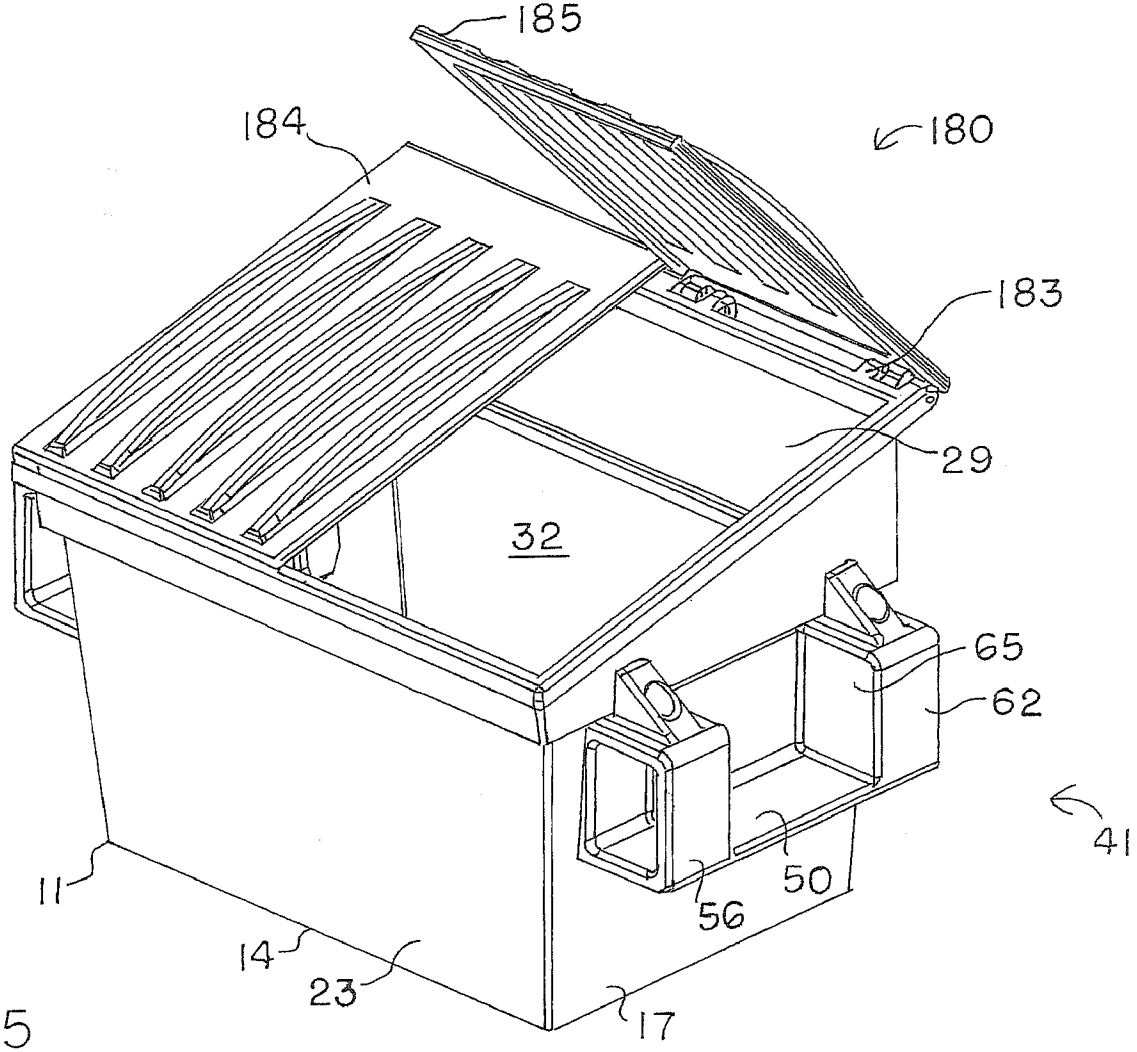
FIG. 5 is a representative perspective view towards the front container wall and first container sidewall of the container assembly of FIG. 1, which further includes reversibly closeable lid components.
Figure 6:
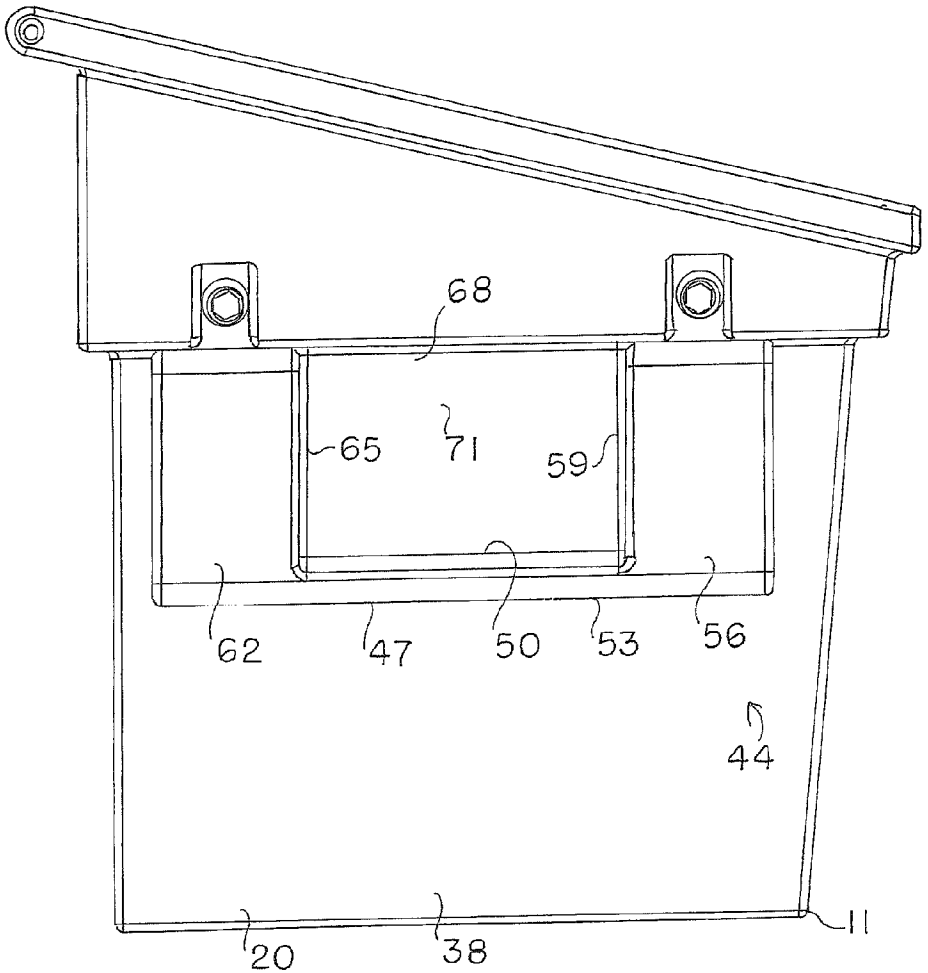
FIG. 6 is a representative side elevational view of the second container sidewall of the container assembly of FIG. 1.

With reference to FIGS. 1 through 6 and 21 of the drawings, a container assembly 1 according to the present invention is depicted. Container assembly 1 includes a container body 11, that includes a container base 14, a first container sidewall 17, a second container sidewall 20, a front container wall 23 and a rear container wall 26. First container sidewall 17, second container sidewall 20, front container wall 23 and rear container wall 26 each extend upwardly from container base 14 and together define an open container top 29 and a container interior 32. First container sidewall 17 and second container sidewall 20 are laterally spaced apart and opposed to each other, and each has an exterior surface: exterior surface 35 for first container sidewall 17; and exterior surface 38 for second container sidewall 20.

Container assembly 1 further includes a first exterior shelf structure 41 that is reversibly attached to exterior surface 35 of first container sidewall 17. In addition, container assembly 1 also includes a second exterior shelf structure 44 that is reversibly attached to exterior surface 38 of second container sidewall 20.

Figure 7:
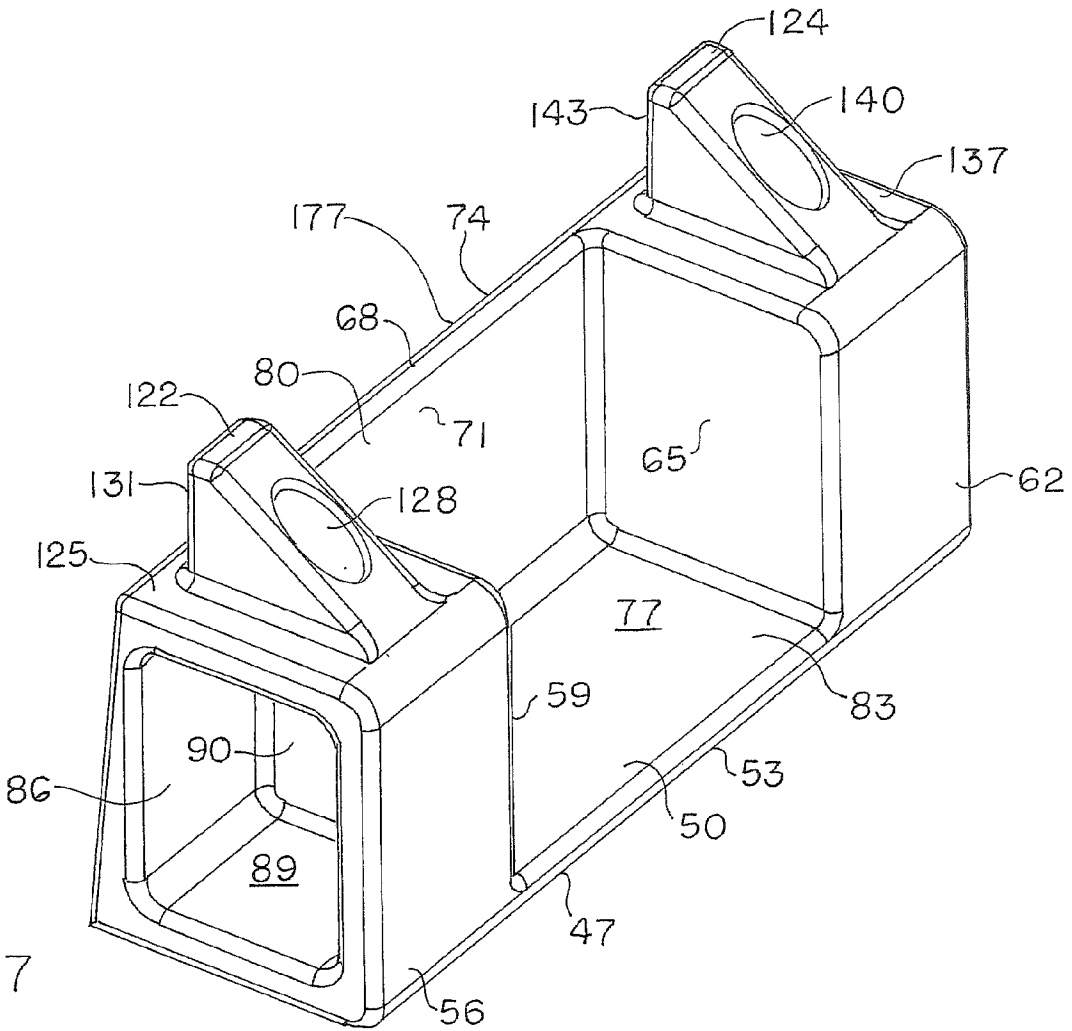
FIG. 7 is a representative perspective view of the first exterior shelf structure alone, of the container assembly of FIG. 1.
Figure 8:
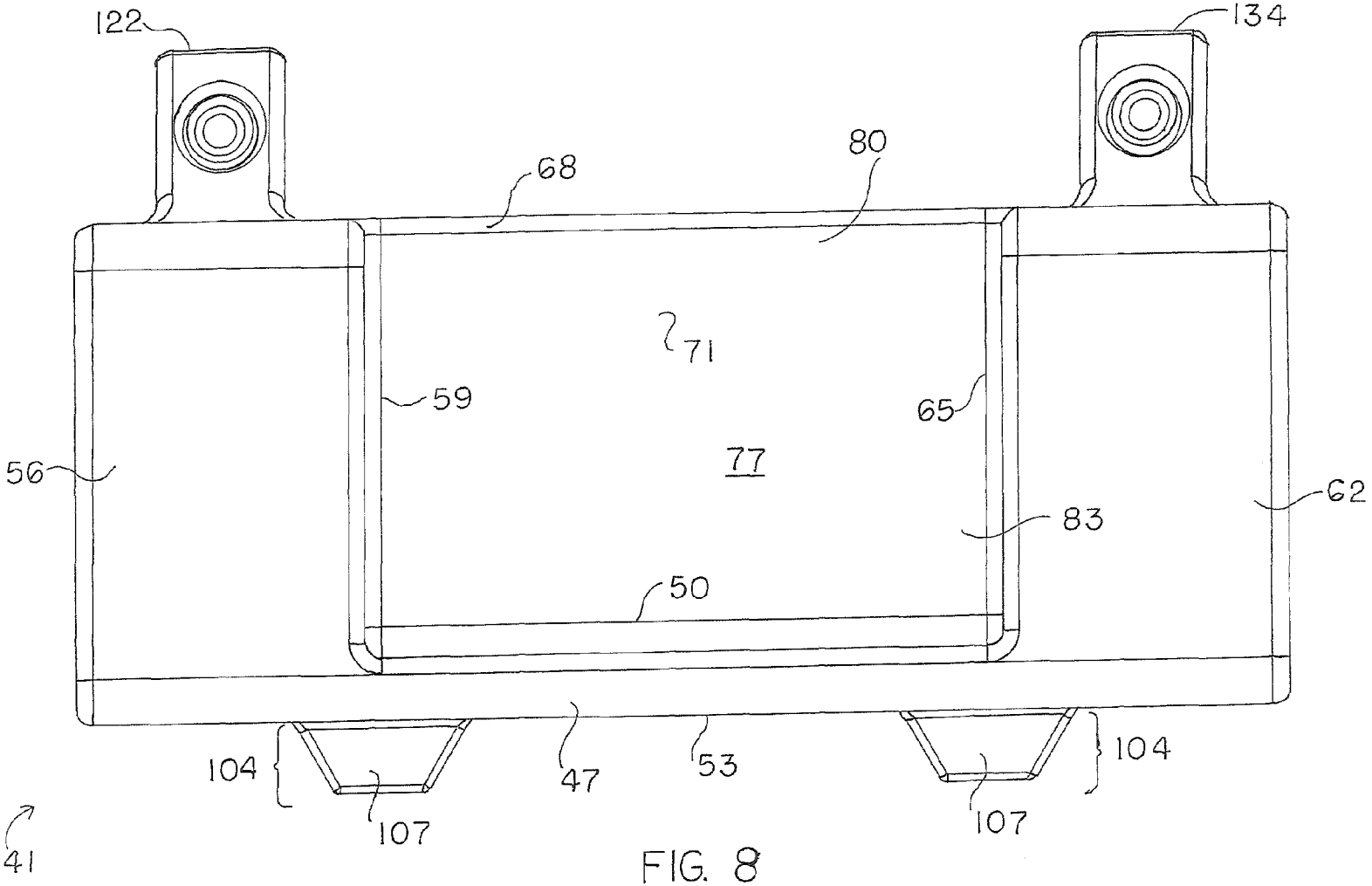
FIG. 8 is a representative side elevational view towards the first surface of the shelf inner wall of the first exterior shelf structure of FIG. 7.
Figure 9:
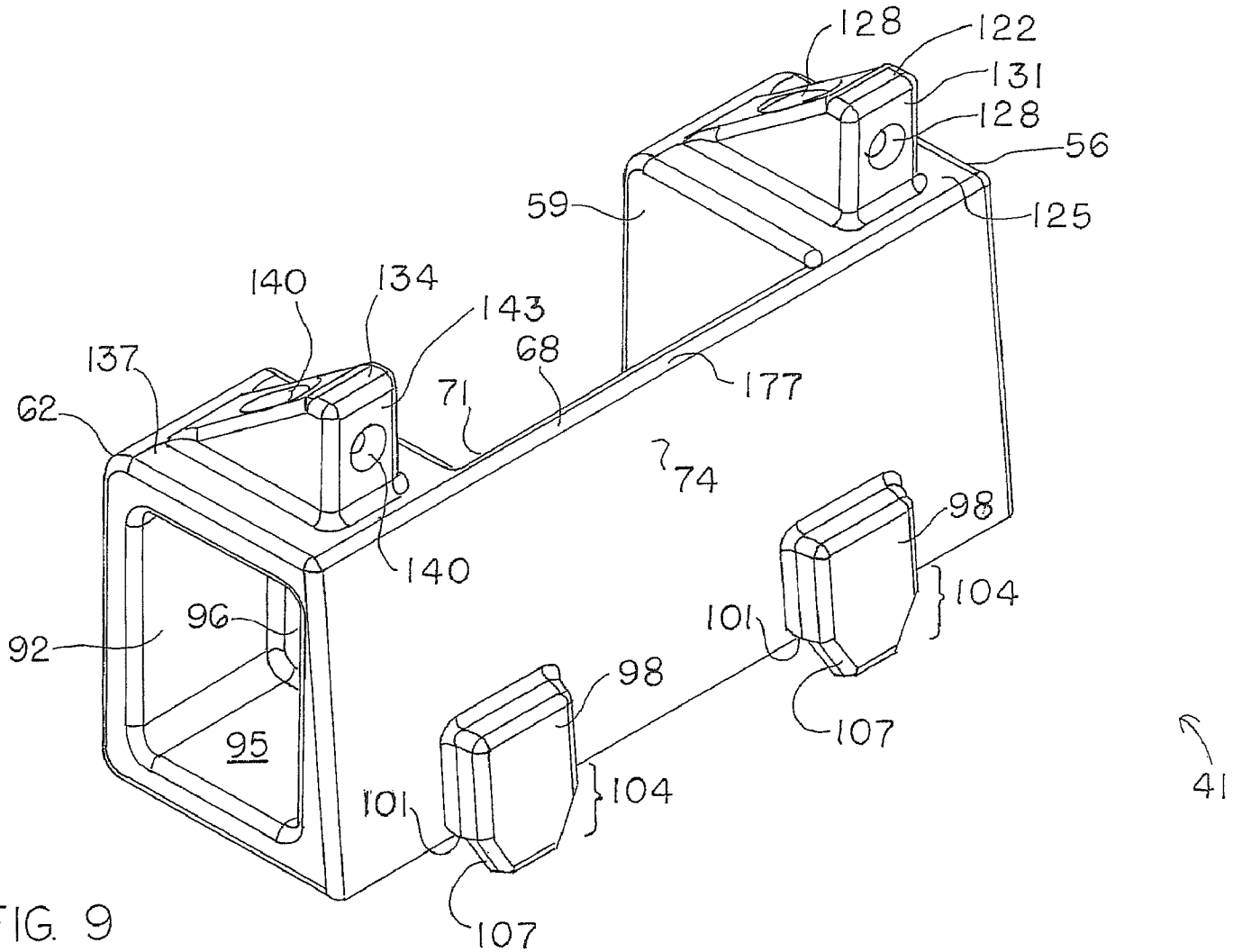
FIG. 9 is a representative perspective view towards the rear shelf portion and second surface of the shelf inner wall of the first exterior shelf structure of FIG. 7.

With reference to FIGS. 7 through 9, the first 41 and second 44 exterior shelf structures each include a shelf base 47 having an upper surface 50 and a lower surface 53. Each exterior shelf structure (first 41, second 44) also includes a forward shelf portion 56 having a rear surface 59, and a rear shelf portion 62 having a forward surface 65. Each exterior shelf structure (first 41, second 44) further includes a shelf inner wall 68 having a first surface 71 and a second surface 74. Forward shelf portion 56, rear shelf portion 62 and shelf inner wall 68 each extend substantially upward from shelf base 47.

The forward (56) and rear (62) shelf portions of each exterior shelf structure may have any suitable shape, such as, box-like shapes, oval shapes, round shapes or irregular shapes. As depicted in the drawings, the forward (56) and rear (62) shelf portions of each exterior shelf structure, each have box-like (e.g., rectatubular) shapes or structures.

For each exterior shelf structure (first 41, second 44), forward shelf portion 56 and rear shelf portion 62 are laterally spaced apart and opposed to each other. In addition, rear surface 59 of forward shelf portion 56, and forward surface 65 of rear shelf portion 62 are in facing opposition to each other.

Each exterior shelf structure (first 41, second 44) includes a shelf space 77 that resides between forward shelf portion 56 and rear shelf portion 62, an open shelf top 80 and an open shelf side 83. More particularly, upper surface 50 of shelf base 47, rear surface 59 of forward shelf portion 56, forward surface 65 of rear shelf portion 62 and first surface 71 of shelf inner wall 68 together define shelf space 77, open shelf top 80 and open shelf side 83. Open shelf top 80 is opposed from upper surface 50 of shelf base 47. Open shelf side 83 is opposed from first surface 71 of shelf inner wall 68. See, for example, FIGS. 7, 8 and 9.

The shelf space (e.g., 77) of each exterior shelf structure is typically independently dimensioned to allow storage of items, such as personal items (e.g., toys, books, utensils and/or tools) therein. Alternatively or in addition to allowing for the storage of items, such as personal items, each shelf space may be independently dimensioned to allow use thereof as a desk and/or as a seat.

Figure 18:
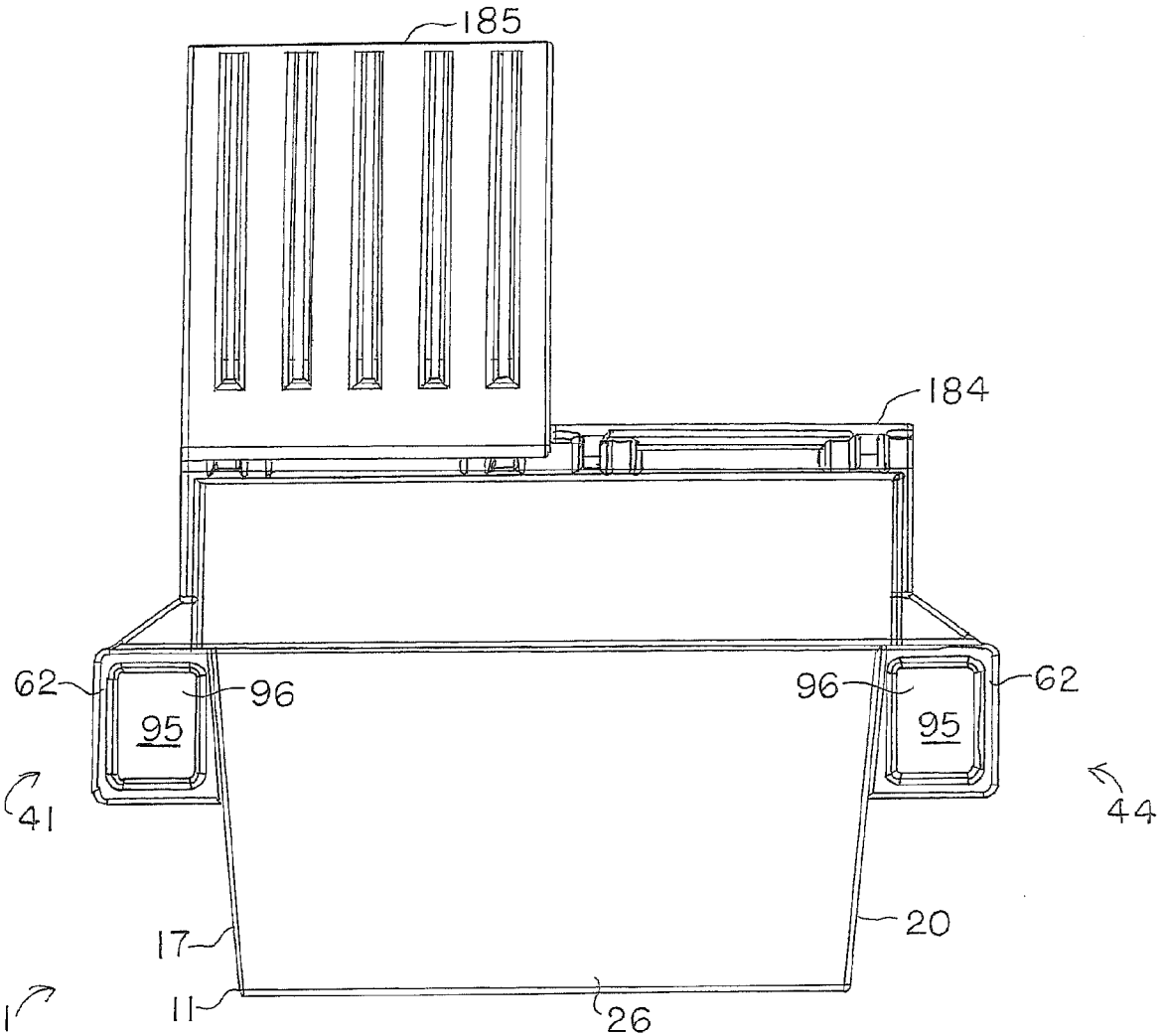
FIG. 18 is a representative rear elevational view of the rear container wall of the container assembly of FIG. 5.
Figure 19:
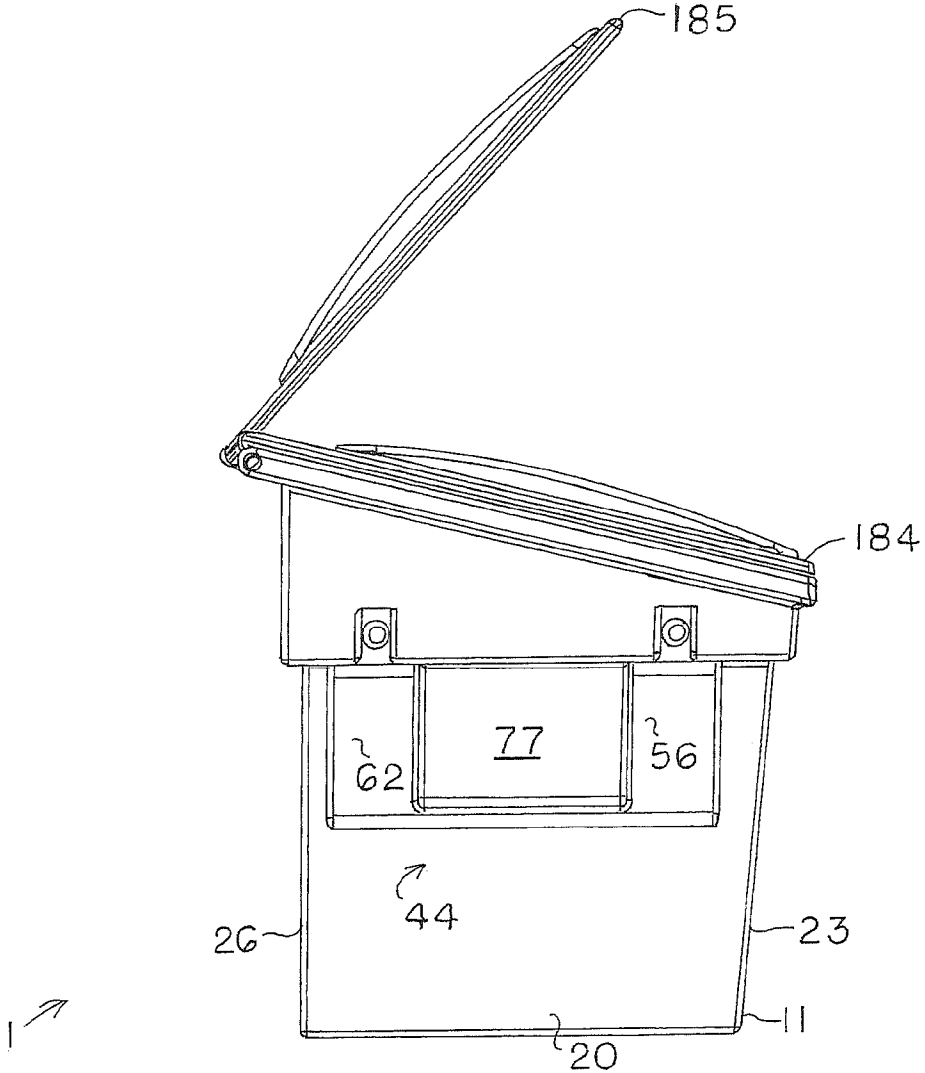
FIG. 19 is a representative side elevational view of the second container sidewall of the container assembly of FIG. 5.
Figure 20:
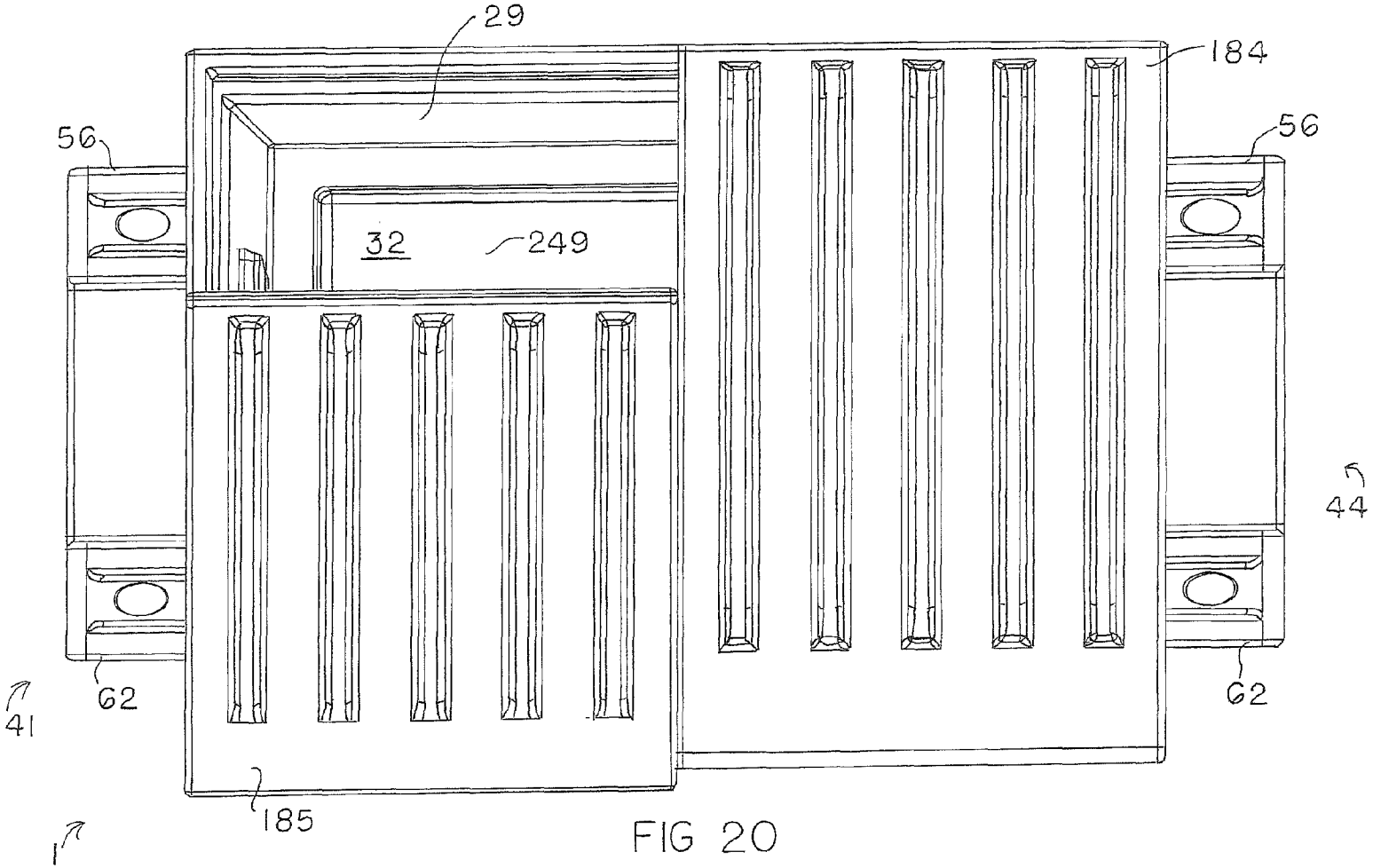
FIG. 20 is a representative top plan view of the container assembly of FIG. 5.
Figure 21:
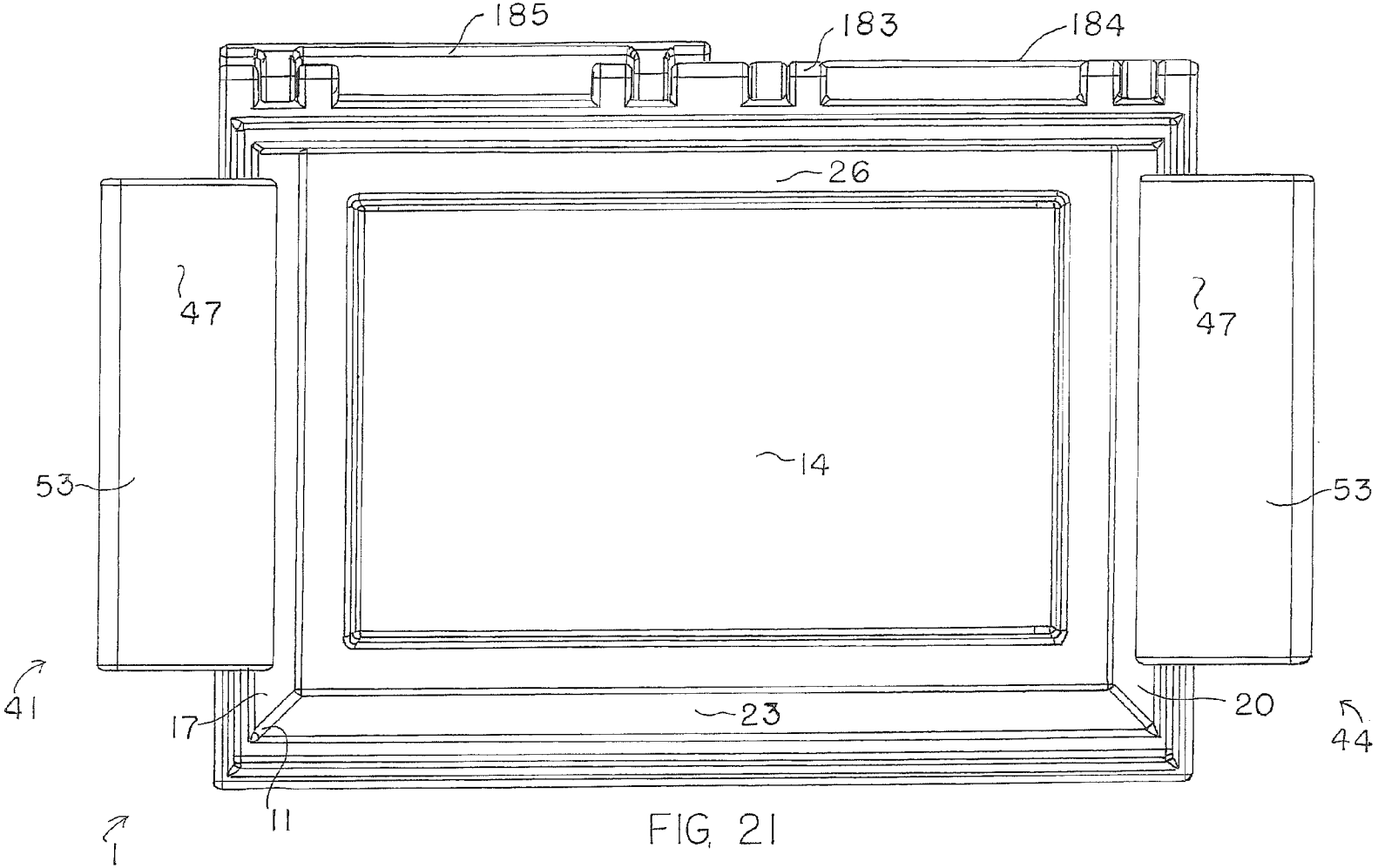
FIG. 21 is a representative bottom plan view of the container base of the container assembly of FIG. 5.

The forward shelf portion 56 of each exterior shelf structure (first 41, second 44) has an open front (or face) 86 (e.g., an open forward face 86) that is in communication with a recessed chamber 89 of the forward shelf portion 56. See, for example, FIG. 7. Recessed chamber 89 is defined in part by a rear wall 90, and as such does not extend all of the way through forward shelf portion 56. See, for example, FIGS. 4, 7 and 13. In an embodiment of the present invention the rear shelf portion 62 of each exterior shelf structure (first 41, second 44) has an open rear (or face) 92 (e.g., an open rear face 92) that is in communication with a recessed chamber 95 of the rear shelf portion 62. See, for example, FIG. 9. Recessed chamber 95 is defined in part by a rear wall 96, and as such does not extend all of the way through rear shelf portion 62. See, for example, FIGS. 9 and 18. The recessed chambers (89, 95) of the forward (56) and rear (62) shelf portions may have any suitable shape, such as tubular shapes having sectional shapes selected from circular shapes, oval shapes, irregular shapes and/or polygonal shapes (e.g., triangular, square, rectangular, pentagonal, hexagonal, heptagonal, octagonal, etc.). As depicted in the drawings, the recessed chambers (89, 95) of the forward (56) and rear (62) shelf portions have substantially tubular shapes having rectangular sectional shapes (e.g., having rectatubular shapes). The recessed chambers (89, 95) of the forward (56) and rear (62) shelf portions are typically dimensioned so as to allow storage of items, such as personal items (e.g., toys, books, utensils and/or tools) therein.

When attached to the container body 11, at least a portion of second surface 74 of shelf inner wall 68 of first exterior shelf structure 41, and a portion of exterior surface 35 of first container sidewall 17 abut each other. Similarly, when attached to container body 11, at least a portion of second surface 74 of shelf inner wall 68 of second exterior shelf structure 44, and a portion of exterior surface 38 of second container sidewall 20 abut each other.

In an embodiment of the present invention, for each of first exterior shelf structure 41 and second exterior shelf structure 44, shelf inner wall 68 extends between and is connected to forward shelf portion 56 and rear shelf portion 62.

The container body of the container assembly of the present invention may be formed by connecting two or more elements thereof (e.g., two or more of, the container base 14, and the first 17, second 20, front 23 and rear 26 container walls) together. In an embodiment of the present invention, container body 11 is a substantially unitary (i.e., a substantially one-piece) container body (as depicted in the drawing figures), and the elements thereof (e.g., the container base 14, and the first 17, second 20, front 23 and rear 26 container walls) are substantially continuous with each other.

The first and second exterior shelf structures (41, 44) of the container assembly of the present invention may be formed by connecting two or more elements thereof (e.g., shelf base 47, forward shelf portion 56, rear shelf portion 62 and shelf inner wall 68) together. In an embodiment of the present invention, the first exterior shelf structure is a substantially unitary first exterior shelf structure, and the second exterior shelf structure is a substantially unitary second exterior shelf structure (e.g., as depicted in the drawing figures with regard to first exterior shelf structure 41 and second exterior shelf structure 44).

In an embodiment of the present invention, the exterior shelf structures are attached to the sidewalls of the container body by means of one or more tabs that are each received through an appropriately aligned and dimensioned tab aperture in the respective container sidewall. More particularly, for each of the first (41) and second (44) exterior shelf structures, second surface 74 of shelf inner wall 68 includes at least one tab 98 that extends outward from second surface 74. Each tab 98 has a lower shoulder 101 and a lower tab portion 104. Each lower tab portion 104 has an inner tab surface 107 (FIG. 8). Lower tab portion 104 extends below (or downward from/relative to) lower tab shoulder 101 and lower surface 53 of shelf base 47. See, for example, FIGS. 8 and 9.

First container sidewall 17 includes at least one tab aperture 110 that is defined in part by a lower edge 113. See, for example, FIGS. 2, 10 and 11. Each tab 98 of first exterior shelf structure 41 is received through an appropriately aligned tab aperture 110. With tab 98 received through tab aperture 110, lower tab portion 104 extends below lower edge 113 of the tab aperture 110. In addition, with tab 98 so received through tab aperture 110, lower edge 113 of tab aperture 110 and lower tab shoulder 101 abut each other. In addition, inner tab surface 107 and a portion of an inner surface 116 of first container sidewall 17 abut each other (not visible in the drawings).

Figure 12:
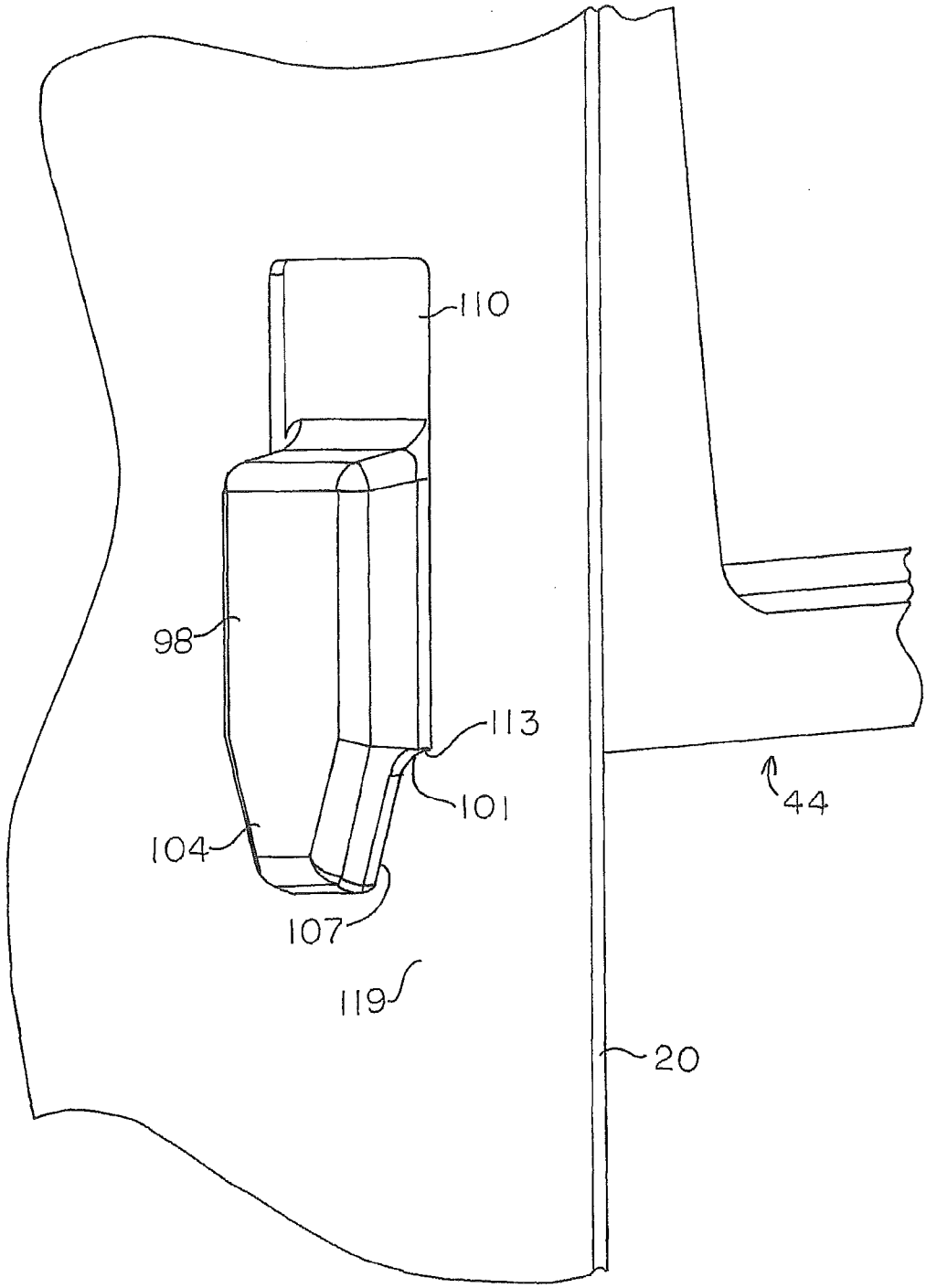
FIG. 12 is a representative partial cut-away perspective interior view of the tab of an exterior shelf structure received through a tab aperture of a sidewall of the container body of the container assembly according to the present invention.

Second container sidewall 20 includes at least one tab aperture 110 that is defined in part by a lower edge 113. Each tab 98 of second exterior shelf structure 44 is received through an appropriately aligned tab aperture 110. With tab 98 received through tab aperture 110, lower tab portion 104 extends below lower edge 113 of the tab aperture 110. In addition, with tab 98 so received through tab aperture 110, lower edge 113 of tab aperture 110 and lower tab shoulder 101 abut each other. In addition, inner tab surface 107 and a portion of an inner surface 119 of second container sidewall 20 abut each other. See, for example, FIG. 12. The relationship between the tabs 98 and the tab apertures 110 is more clearly depicted with reference to FIG. 12, which depiction is equivalently applicable to the tabs 98 of first exterior shelf structure 41 and tab apertures 110 of first sidewall 17.

The exterior shelf structures each have at least one tab, and typically at least two tabs (e.g., 1, 2, 3, 4 or 5 tabs), and the respective sidewall of the container body typically has a equal number of appropriately aligned and dimensioned tab apertures (e.g., 1, 2, 3, 4 or 5 tab apertures). In an embodiment of the present invention, the first exterior shelf structure 41 and the second exterior shelf structure 44 each have two tabs 98 that are in each case laterally spaced from each other, as depicted in the drawing figures (e.g., FIGS. 8 and 9). Accordingly the first container sidewall 17 and the second container sidewall 20 each have two tab apertures 110 that are laterally spaced apart, positioned and dimensioned (as depicted in the drawing figures) so as to each receive one tab 98 therein (e.g., FIG. 2).

Alternatively or in addition to the tabs being received within the tab apertures, the exterior shelf structures may further include one or more (e.g., at least two) upwardly extending extensions that are fastened to the exterior surface of the respective container sidewall. In an embodiment, for each of the first exterior shelf structure 41 and the second exterior shelf structure 44, the forward shelf portion 56 has a first extension 122 extending upwardly from an upper surface 125 of forward shelf portion 56. First extension 122 has an aperture 128 extending there-through and a second surface 131. For the first (41) and second (44) exterior shelf structures, the rear shelf portion 62 has a second extension 134 extending upwardly from an upper surface 137 of rear shelf portion 62. Second extension 137 has an aperture 140 extending there-through and a second surface 143. See, for example, FIGS. 7-9.

With first exterior shelf structure 41 reversibly attached to first sidewall 17 of container body 11, second surface 131 of first extension 122 abuts exterior surface 35 of first container sidewall 17, and aperture 128 of first extension 122 is aligned with a first aperture 147 of first container sidewall 17. A first fastener 150 is received through aperture 128 of first extension 122 and first aperture 147 of first container sidewall 17. Second surface 143 of second extension 134 abuts exterior surface 35 of first container sidewall 17, and aperture 140 of second extension 134 is aligned with a second aperture 153 of first container sidewall 17. A second fastener 156 is received through aperture 140 of second extension 134 and second aperture 153 of first container sidewall 17. See, for example, FIGS. 1 and 2.

With second exterior shelf structure 44 reversibly attached to second sidewall 20 of container body 11, second surface 131 of first extension 122 abuts exterior surface 38 of second container sidewall 20, and aperture 128 of first extension 122 is aligned with a first aperture 147 of second container sidewall 20. A first fastener 150 is received through aperture 128 of first extension 122 and first aperture 147 of second container sidewall 20. Second surface 143 of second extension 134 abuts exterior surface 38 of second container sidewall 20, and aperture 140 of second extension 134 is aligned with a second aperture 153 of second container sidewall 20. A second fastener 156 is received through aperture 140 of second extension 134 and second aperture 153 of second container sidewall 20. See, for example, FIGS. 1 and 2.

The fasteners (e.g., 150 and 156) used to connect the first and second exterior shelf structures to the exterior surfaces of the respective sidewalls, may be selected from art-recognized fasteners, such as nut and bolt combinations, rivets, screws and rods. As depicted in the drawing figures, the fasteners are in the form of nut and bolt combinations, which include nuts 159 and washers 162.

In an embodiment, the container sidewalls may include an overhang that portions of the exterior shelf structures abut up under when attached to the exterior of the container sidewalls. The overhang may assist in aligning: apertures of the sidewalls with apertures of the extensions of the exterior shelf structures; and/or tab apertures of the sidewalls with tabs of the exterior shelf structures. The first container sidewall 17 and the second container sidewall 20 may each further include a container sidewall upper portion 165 and a container sidewall lower portion 168. Container sidewall upper portion 165 extends outward relative to container sidewall lower portion 168, and defines an overhang 171 having an exterior lower surface 174. See, for example, FIG. 4.

A portion of upper surface 125 of forward shelf portion 56 of first exterior shelf structure 41 abuts a portion of exterior lower surface 174 of overhang 171 of first container sidewall 17, and a portion of upper surface 137 of rear shelf portion 62 of first exterior shelf structure 41 abuts a portion of exterior lower surface 174 of overhang 171 of first container sidewall 17. Similarly with second exterior shelf structure 44, a portion of upper surface 125 of forward shelf portion 56 of second exterior shelf structure 44 abuts a portion of exterior lower surface 174 of overhang 171 of second container sidewall 20, and a portion of upper surface 137 of rear shelf portion 62 of second exterior shelf structure 44 abuts a portion of exterior lower surface 174 of overhang 171 of second container sidewall 20.

Alternatively or in addition to the upper surfaces of the forward and rear shelf portions abutting the exterior lower surface of the overhang, an upper edge of the shelf inner wall of each exterior shelf structure may abut a portion of the exterior lower surface of the overhang of the respective container sidewall, in an embodiment of the present invention. Such an alternative or additional abutting relationship may serve to better position the exterior shelf structures on the exterior surface of the container sidewalls. With this particular embodiment, an upper edge 177 of shelf inner wall 68 of first exterior shelf structure 41 abuts a portion of exterior lower surface 174 of overhang 171 of first container sidewall 17. Similarly, an upper edge 177 of shelf inner wall 68 of second exterior shelf structure 44 abuts a portion of exterior lower surface 174 of overhang 171 of second container sidewall 20.

Figure 13:
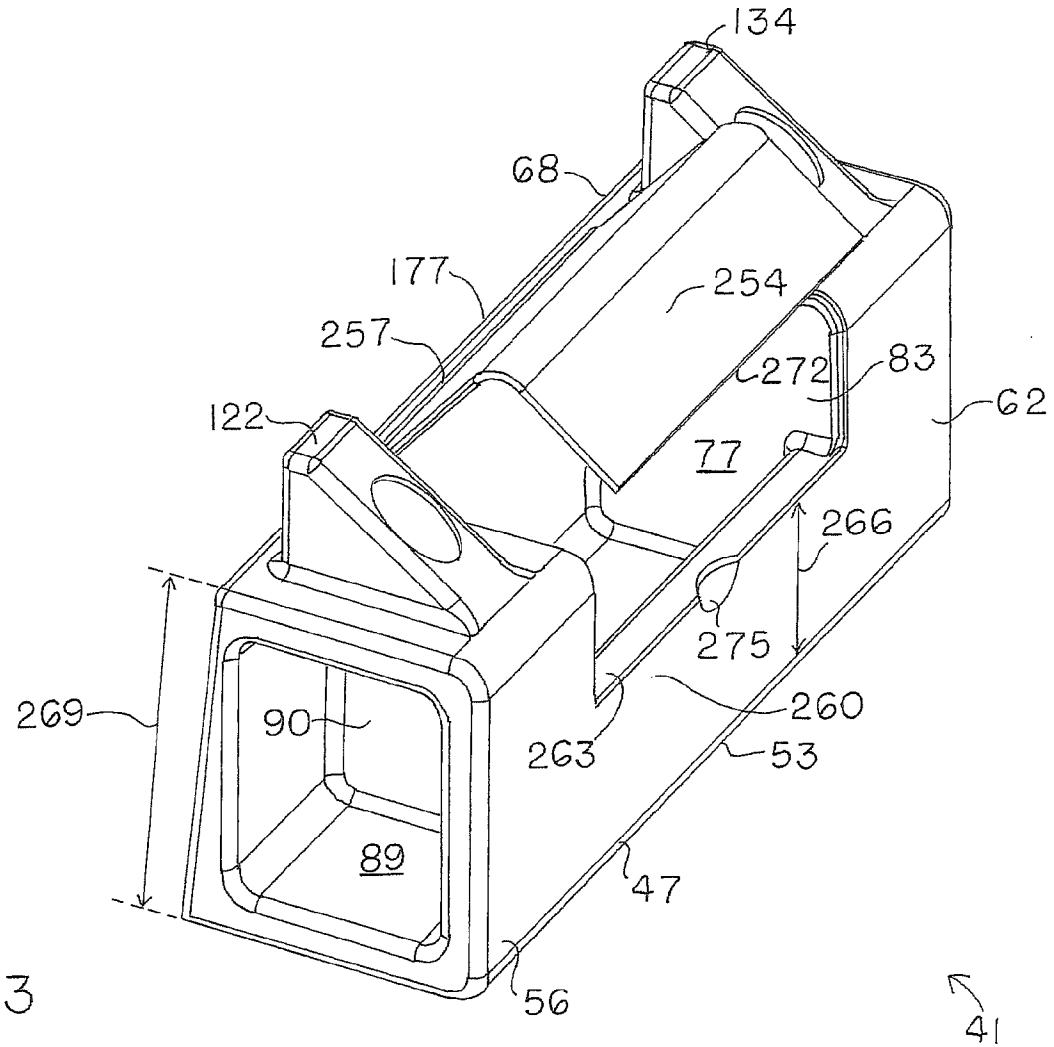
FIG. 13 is a representative perspective view of an exterior shelf structure alone, that further includes a reversibly closeable shelf lid, in which the shelf lid is partially open.
Figure 14:
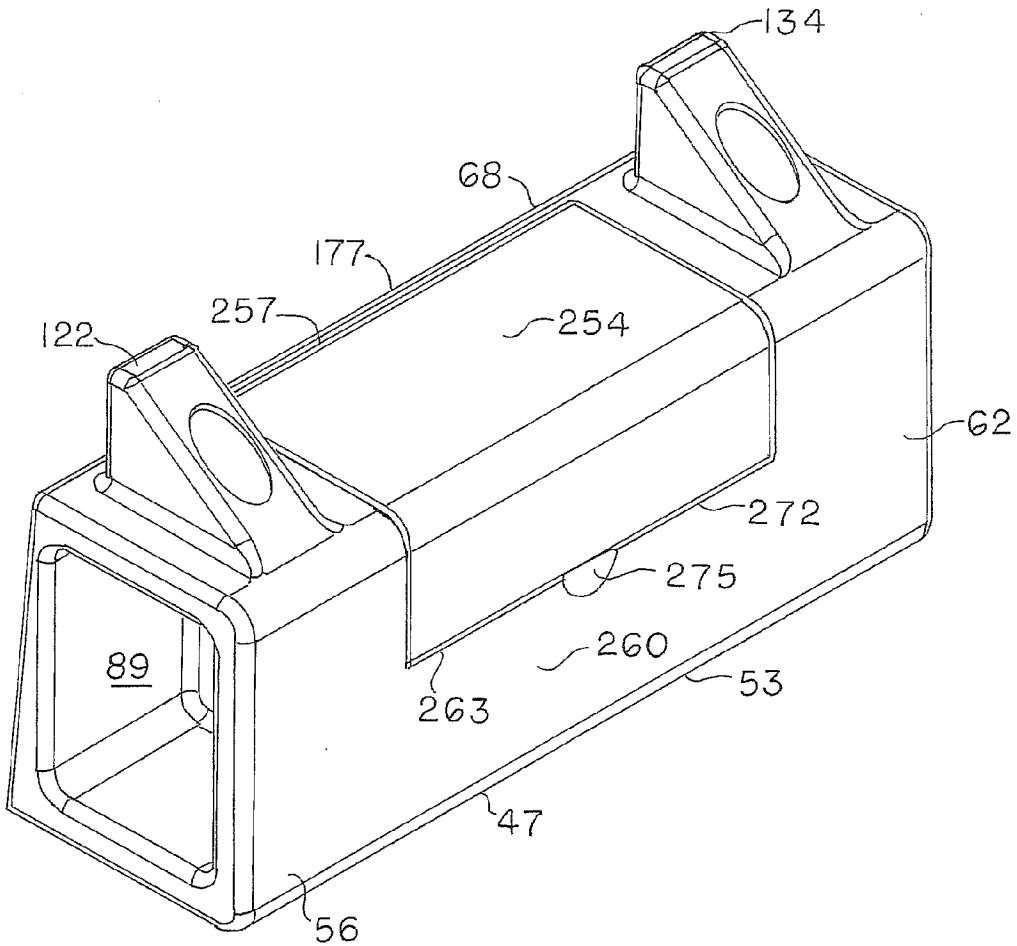
FIG. 14 is a representative perspective view of the exterior shelf structure of FIG. 13, in which the shelf lid is closed.
Figure 15:
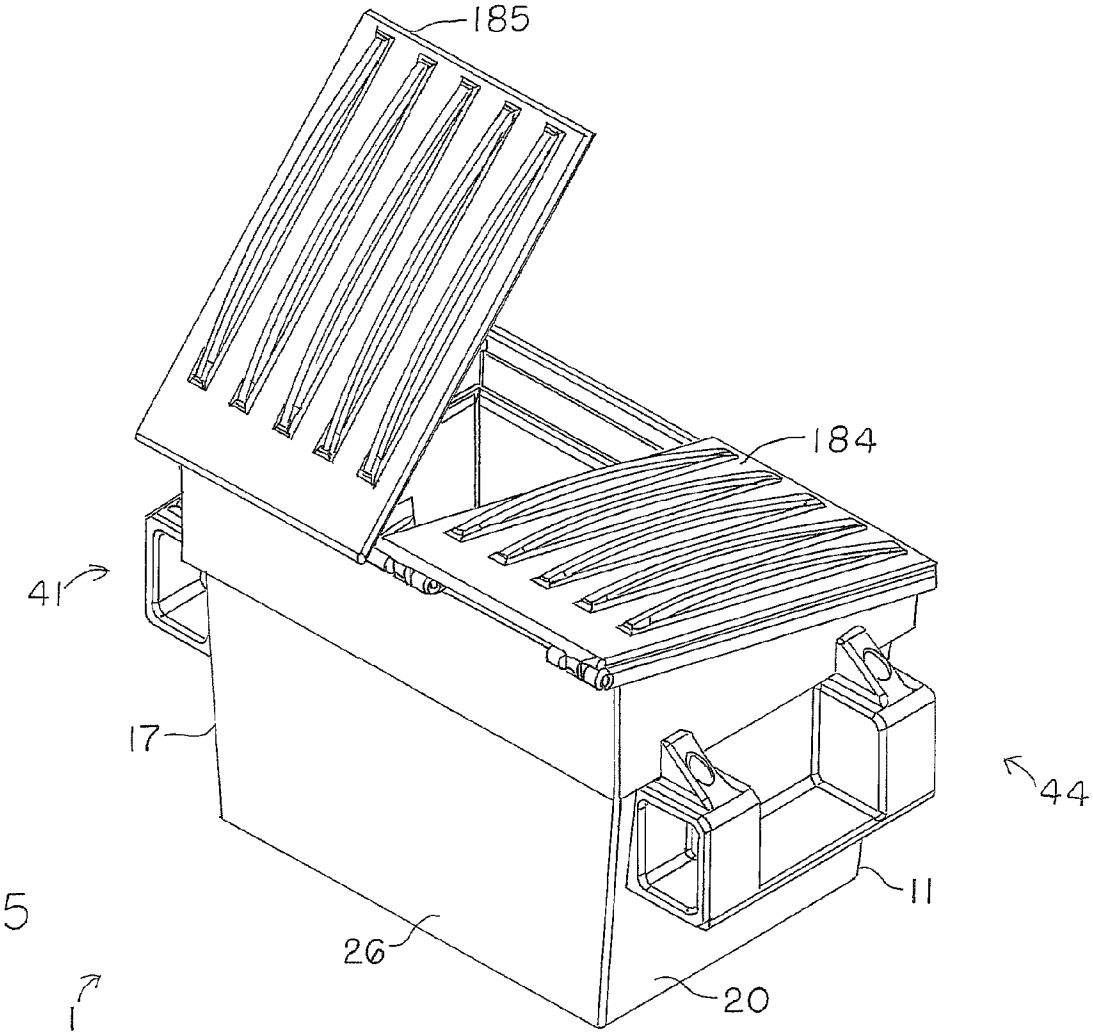
FIG. 15 is a representative perspective view towards the rear container wall and second container sidewall of the container assembly of FIG. 5.
Figure 16:
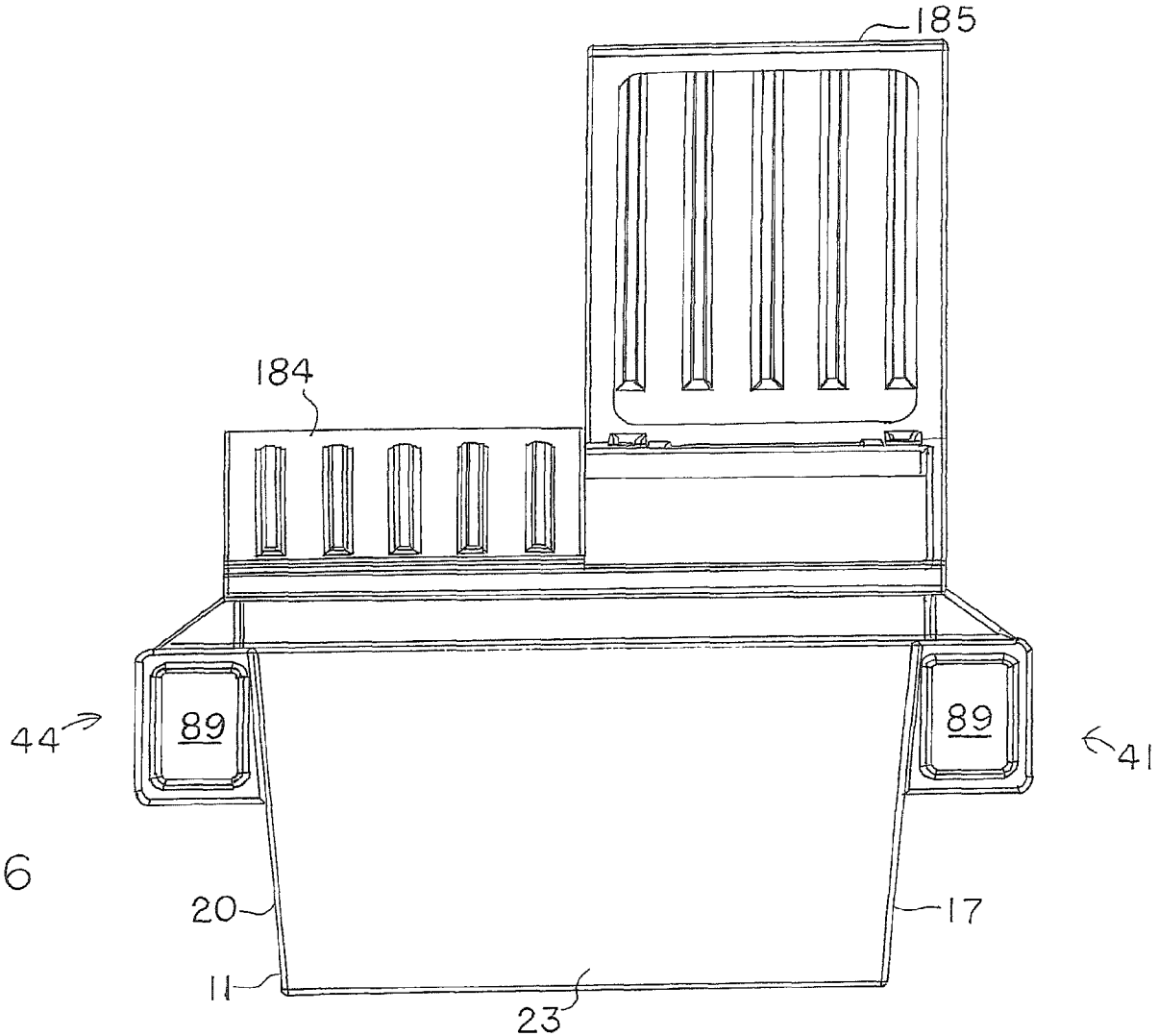
FIG. 16 is a representative front elevational view of the front container wall of the container assembly of FIG. 5.
Figure 17:
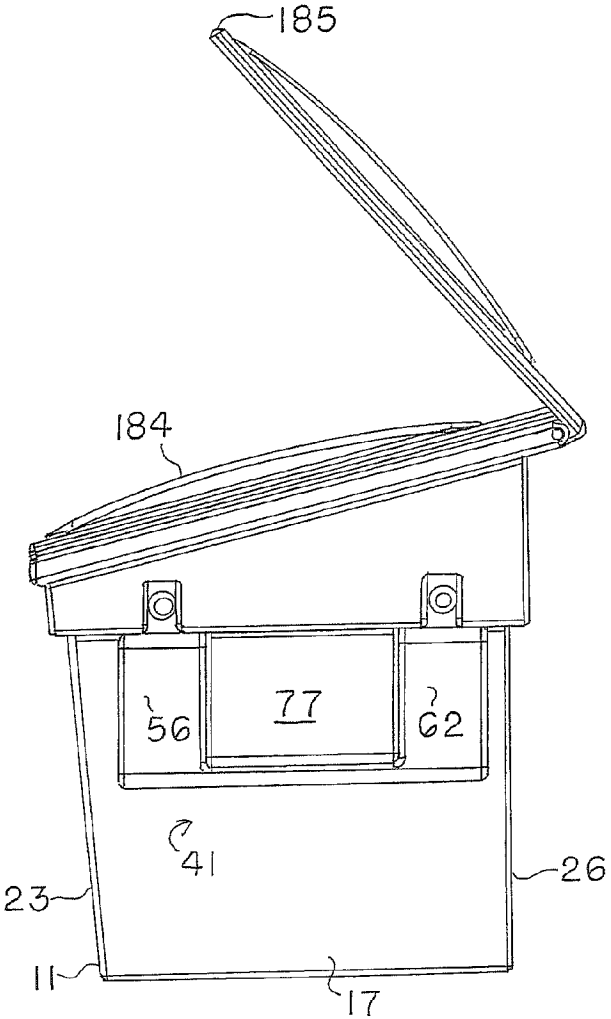
FIG. 17 is a representative side elevational view of the first container sidewall of the container assembly of FIG. 5.

The first and second exterior shelf structures may each further include a reversibly closeable lid that reversibly closes the shelf space. The reversibly closeable shelf lid typically has a first edge that is hingedly attached to the shelf inner wall. With reference to FIGS. 13 and 14, first exterior shelf structure 41 further includes a reversibly closeable shelf lid 254 that reversibly closes shelf space 77. Shelf lid 254 has a first edge 257 that is hingedly attached to shelf inner wall 68. First edge 257 of shelf lid 254 may be hingedly attached to any portion of shelf inner wall 68. Typically, first edge 257 of shelf lid 254 is hingedly attached to upper edge 177 of shelf inner wall 68, as depicted in the drawings.

In a further embodiment of the present invention, in addition to having a reversibly closeable shelf lid, the exterior shelf structures may each have an outer shelf wall having an upper edge. The outer shelf wall has a vertical height that is less than the vertical height of the shelf inner wall. The outer shelf wall allows items (e.g., personal items, such as small toys or books) to be more securely stowed within the shelf space. With further reference to FIGS. 13 and 14, first exterior shelf structure 41 has an outer shelf wall 260 having an upper edge 263. Outer shelf wall 260 extends upwardly from base 47 of first exterior shelf structure 41. Upper edge 263 of out shelf wall 260 has a vertical height 266 that is less than vertical height 269 of upper edge 177 of shelf inner wall 68 (in each case relative to lower surface 53 of shelf base 47). Typically the vertical height 266 of outer shelf wall 260 is from 10 percent to 75 percent (e.g., from 25 to 60 percent, such as about 50 percent) of the vertical height 269 of shelf inner wall 68. Reversibly closeable shelf lid 254 has a second edge 272 that abuts upper edge 263 of outer shelf wall 260, when shelf lid 254 is closed.

Each shelf lid may include a handle and/or indentation (not shown) to assist with manual opening and closing of the shelf lid. Alternatively or in addition thereto, outer shelf wall 260 may include an indentation 275 that is in communication with upper edge 263 of outer shelf wall 260. Indentation 275 provides access to second edge 272 of shelf lid 254, so as to allow shelf lid 254 to be lifted and/or lowered (e.g., by means of a finger) relative to upper surface 263 of outer shelf wall 260. The shelf lids may optionally be lockable when closed, by art-recognized locking means (not shown in the drawings).

The exterior shelf structures of the container assembly may be removed (e.g., detached) from the exterior surface of the sidewalls of the container body, and stored within the interior (e.g., 32) of the container body. Storing the exterior shelf structures within the interior of the container body reduces the width of the container assembly, and allows the container assembly itself (and more particularly the container body thereof) to be stored (and optionally shipped) in a smaller area than would be required if the exterior shelf structures were permanently attached to the sidewalls of the container body.

The container assembly of the present invention may further include a reversibly closeable lid. See, for example, FIGS. 5 and 15-20. The lid may rest on an upper portion of the container body, or it may be hingedly attached to an upper portion of the container body. The hingedly attached lid (or lid components) may be reversibly removable, for example, by means of snap-fitting hinge components, such as hemispherical snap-fitting hinge components (not shown in the drawings). In an embodiment, container assembly 1 further includes a reversibly closeable lid 180 that is hingedly attached to an upper portion of container body 11 by means of hinge lugs 183 attached to the upper portion of container body 11. See, for example, FIGS. 3 and 5. Lid 180 may be in the form of a single lid component, or may have a plurality of separate lid components (or elements) that are each reversibly closeable. As depicted in the drawings (e.g., FIG. 5), lid 180 has two separate lid components 184 and 185 that are each hingedly attached to the upper portion of container body 11 by means of hinge lugs 183, and which are each separately reversibly closeable.

Figure 10:
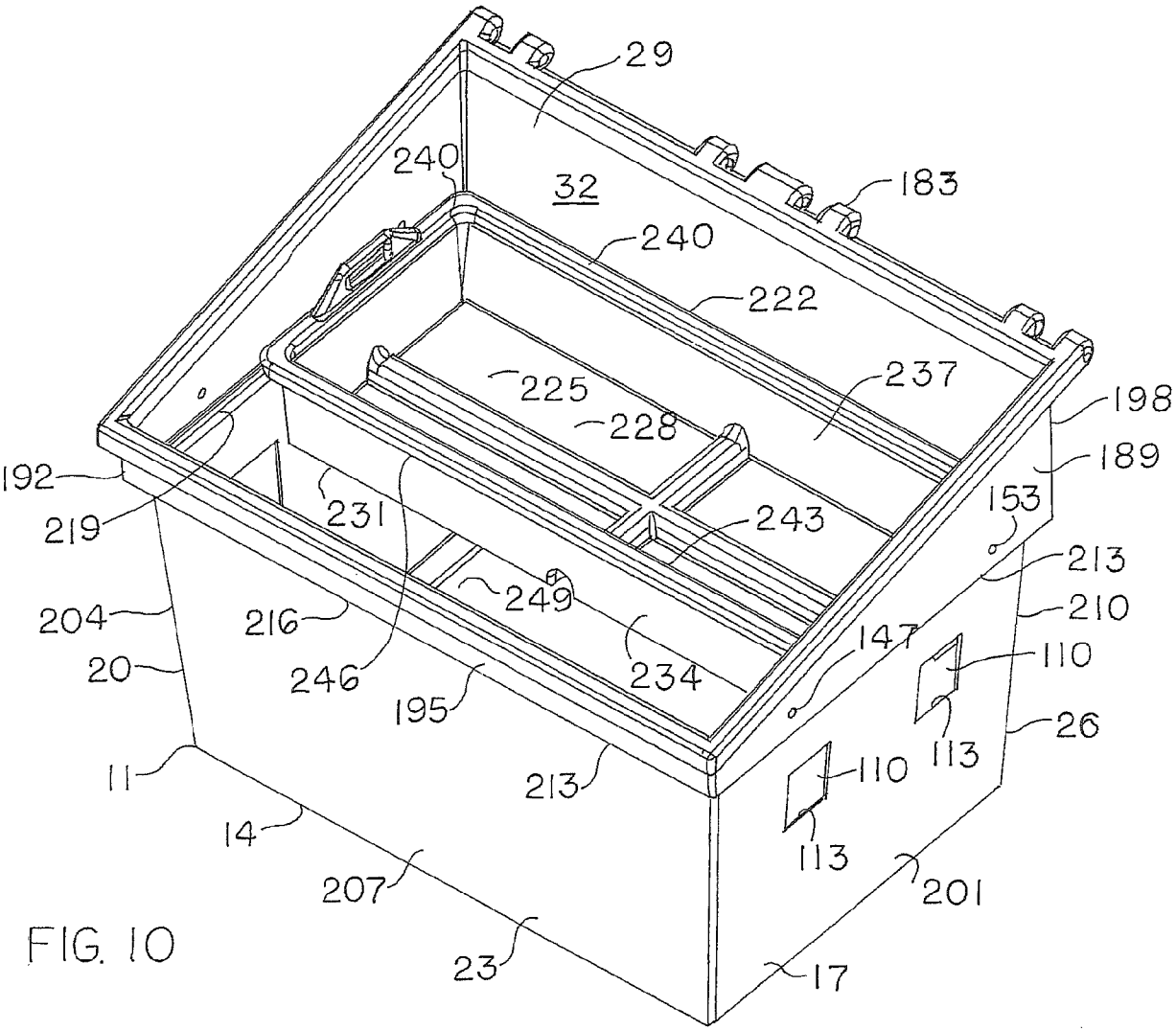
FIG. 10 is a representative perspective view of the container assembly of FIG. 1, without exterior shelf structures, and further including an interior container in the form of a tray.
Figure 11:
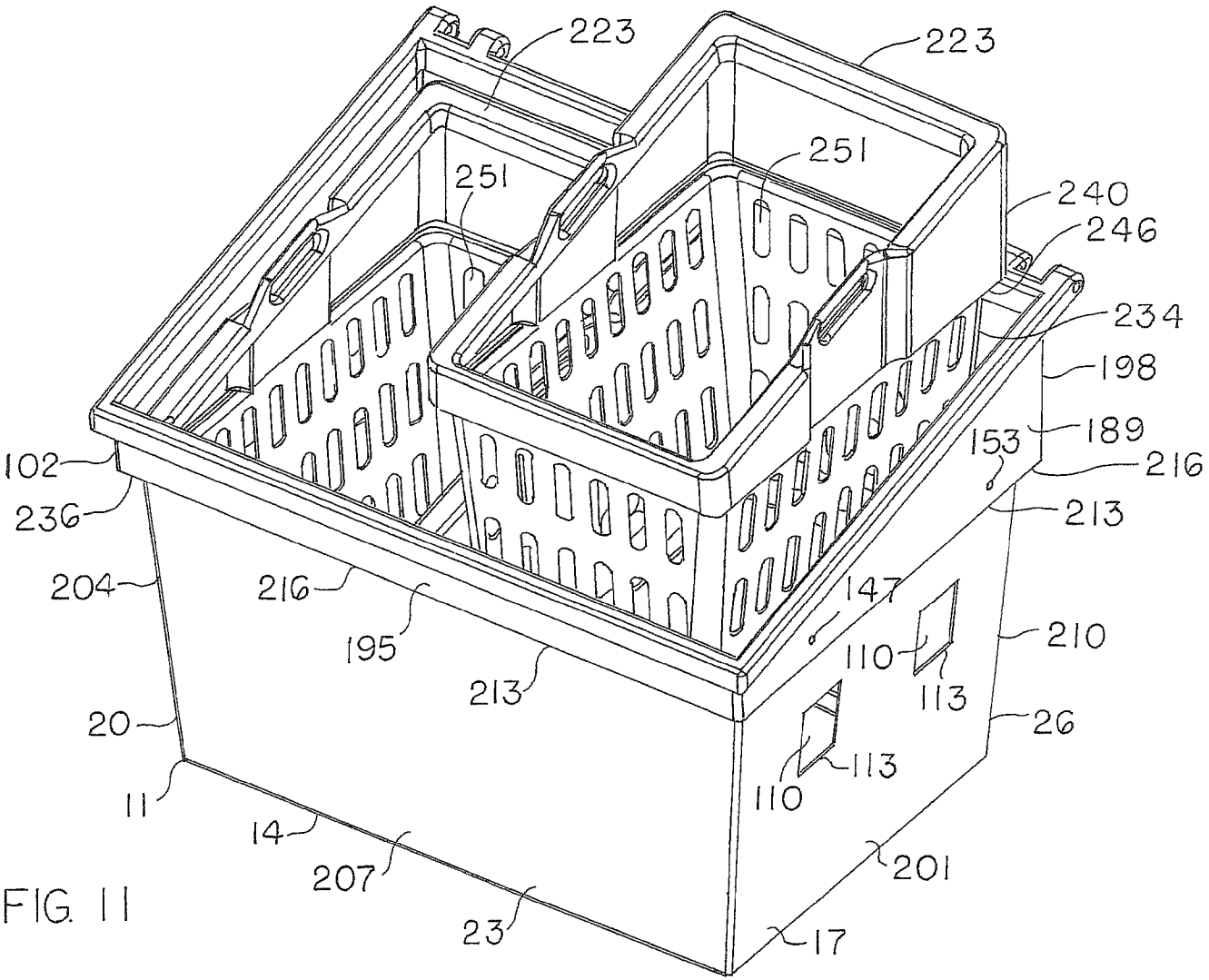
FIG. 11 is a representative perspective view of the container assembly of FIG. 1, without exterior shelf structures, and further including interior containers in the form of baskets.

The container assembly of the present invention may optionally include one or more removable interior containers that reside suspended within the interior of the container body. With reference to FIGS. 10 and 11, first container sidewall 17, second container sidewall 20, front container wall 23 and rear container wall 26 each have an upper wall portion (189, 192, 195 and 198 respectively) and a lower wall portion (201, 204, 207 and 210 respectively). In each case, the upper wall portion (189, 192, 195 and 198 respectively) extends outward relative to the lower wall portion (201, 204, 207 and 210 respectively), and together define a container overhang 213 having an exterior lower surface 216 and an interior upper surface 219 residing within container interior 32.

In this embodiment, the container assembly further includes an interior container 222 having a base 225 having an upper surface 228 and a lower surface 231, a sidewall structure 234 extending upwardly from base 225, which defines an open top 237 thereof. Interior container 222 also has an upper lip 240 that extends laterally outward from an upper portion 243 of the sidewall structure 234 thereof. At least a portion of a lower surface 246 of upper lip 240 abuts at least a portion of interior upper surface 219 of container overhang 213, thereby suspending lower surface 231 of base 225 of interior container 222 above an upper surface 249 of base 14 of container body 11.

With reference to FIG. 11, the container assembly includes two interior containers 223 in the form of hampers, that are substantially as described with regard to interior container 222 of FIG. 10. The sidewall structures 234 of each interior container 223 includes a plurality of apertures 251.

The container assembly and the components thereof (e.g., container body, exterior shelf structures, one or more lid components, and one or more interior containers) may each be fabricated from any suitable material or materials, such as wood, metal (e.g., aluminum and/or steel), and/or plastic. In an embodiment the components of the container assembly, including the container body, first and second exterior shelf structures, and the lid component(s), are each independently fabricated from a plastic material selected independently from the group consisting of thermoset plastic materials, thermoplastic materials and combinations thereof.

As used herein and in the claims, the term "thermoset plastic material" and similar terms, such as "thermosetting or thermosetable plastic materials" means plastic materials having, or that form, a three dimensional crosslinked network resulting from the formation of covalent bonds between chemically reactive groups, e.g., active hydrogen groups and free isocyanate groups, or between unsaturated groups.

Thermoset plastic materials from which the plastic components of the container assembly (e.g., the container body, first and second exterior shelf structures, the lid component (s), and the one or more interior containers) may be fabricated, include those known to the skilled artisan, e.g., crosslinked polyurethanes, crosslinked polyepoxides, crosslinked polyesters and crosslinked polyunsaturated polymers. The use of thermosetting plastic materials typically involves the art-recognized process of reaction injection molding. Reaction injection molding typically involves, as is known to the skilled artisan, injecting separately, and preferably simultaneously, into a mold, for example: (i) an active hydrogen functional component (e.g., a polyol and/or polyamine); and (ii) an isocyanate functional component (e.g., a diisocyanate such as toluene diisocyanate, and/or dimers and trimers of a diisocyanate such as toluene diisocyanate). The filled mold may optionally be heated to ensure and/or hasten complete reaction of the injected components.

As used herein and in the claims, the term "thermoplastic material" and similar terms, means a plastic material that has a softening or melting point, and is substantially free of a three dimensional crosslinked network resulting from the formation of covalent bonds between chemically reactive groups, e.g., active hydrogen groups and free isocyanate groups. Examples of thermoplastic materials from which the plastic components of the container assembly (e.g., the container body, first and second exterior shelf structures, the lid component(s), and the one or more interior containers) may be fabricated include, but are not limited to, thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polyolefins, thermoplastic(meth)acrylates, thermoplastic acrylonitrile-butadiene-styrene, thermoplastic styrene-acrylonitrile, thermoplastic acrylonitrile-stryrene-acrylate and combinations thereof (e.g., blends and/or alloys of at least two thereof).

In an embodiment, the plastic components of the container assembly are each independently fabricated from one or more thermoplastic polyolefins, and in particular polyethylene. The various components of the container assembly may be fabricated by art-recognized plastic molding methods, such as injection molding, compression molding, rotational molding and blow molding. For example, the various components of the container assembly may be fabricated from rotational molding and/or blow molding methods using polyethylene resins, such as one or more SURPASS polyethylene resins, available commercially from NOVA Chemicals Inc.

The plastic material from which the plastic components of the container assembly (e.g., the container body, first and second exterior shelf structures, the lid component(s), and the one or more interior containers) may be fabricated, may optionally include a reinforcing material selected, for example, from glass fibers, glass beads, carbon fibers, metal flakes, metal fibers, polyamide fibers (e.g., KEVLAR polyamide fibers), cellulosic fibers, nanoparticulate clays, talc and mixtures thereof. If present, the reinforcing material is typically present in a reinforcing amount, e.g., in an amount of from 5 percent by weight to 60 or 70 percent by weight, based on the total weight of the component. The reinforcing fibers, and the glass fibers, in particular, may have sizings on their surfaces to improve miscibility and/or adhesion to the plastic materials into which they are incorporated, as is known to the skilled artisan.

In addition or alternatively to reinforcing material(s), the plastic materials of the plastic components of the container assembly (e.g., the container body, first and second exterior shelf structures, the lid component(s), and the one or more interior containers) may optionally include one or more additives. Additives that may be present in the plastic materials of the components of the container assembly include, but are not limited to, antioxidants, colorants, e.g., pigments and/or dyes, mold release agents, fillers, e.g., calcium carbonate, ultraviolet light absorbers, fire retardants and mixtures thereof. Additives may be present in the plastic material in functionally sufficient amounts, e.g., in amounts independently from 0.1 percent by weight to 10 percent by weight, based on total weight.

The container assembly of the present invention may have any suitable overall appearance and shape. For example, the container assembly may have an overall appearance and shape selected from box-like shapes, cylindrical shapes, sports ball shapes (e.g., baseballs, American footballs, rugby balls and soccer balls), sports helmet shapes (e.g., baseball batting helmets, American football helmets, hockey helmets, and bicycle helmets), or dumpster shapes. In a particular embodiment of the present invention, and as depicted in the drawings, container assembly 1 has a dumpster shape and appearance, and the removable exterior shelf structures thereof each have the appearance and shape of a fork lift pocket.

The present invention has been described with reference to specific details of particular embodiments thereof. It is not intended that such details be regarded as limitations upon the scope of the invention except insofar as and to the extent that they are included in the accompanying claims.

What is claimed is:

1. A container assembly comprising:

(a) a container body comprising, a container base, a first container sidewall, a second container sidewall, a front container wall and a rear container wall, said first container sidewall, said second container sidewall, said front container wall and said rear container wall each extending upwardly from said container base and together defining an open container top and a container interior, said first container sidewall and said second container sidewall being laterally spaced apart and opposed from each other and each having an exterior surface;

(b) a first exterior shelf structure removably attached to said exterior surface of said first container sidewall; and (c) a second exterior shelf structure removably attached to said exterior surface of said second container sidewall, wherein said first exterior shelf structure and said second exterior shelf structure each comprise, a shelf base having an upper surface, a lower surface, a forward shelf portion having a rear surface, a rear shelf portion having a forward surface, and a shelf inner wall having a first surface and a second surface, said forward shelf portion, said rear shelf portion and said shelf inner wall, each extending upwardly from said shelf base, said forward shelf portion and said rear shelf portion being laterally spaced apart and opposed to each other, said rear surface of said forward shelf portion and said forward surface of said rear shelf portion being in facing opposition to each other, said upper surface of said shelf base, said rear surface of said forward shelf portion, said forward surface of said rear shelf portion and said first surface of said shelf inner wall together defining a shelf space, an open shelf top and an open shelf side, said open shelf top being opposed from said upper surface of said shelf base, and said open shelf side being opposed from said first surface of said shelf inner wall, said forward shelf portion having an open front that is in communication with a recessed chamber of said forward shelf portion, further wherein, at least a portion of said second surface of said shelf inner wall of said first exterior shelf structure, and a portion of said exterior surface of said first container sidewall abutting each other, and at least a portion of said second surface of said shelf inner wall of said second exterior shelf structure, and a portion of said exterior surface of said second container sidewall abutting each other.

2. The container assembly of claim 1 wherein for each of said first exterior shelf structure and said second exterior shelf structure, said shelf inner wall extends between and is connected to said forward shelf portion and said rear shelf portion.

3. The container assembly of claim 1 wherein said container body is a substantially unitary container body.

4. The container assembly of claim 3 wherein said first exterior shelf structure is a substantially unitary first exterior shelf structure, and said second exterior shelf structure is a substantially unitary second exterior shelf structure.

5. The container assembly of claim 1 wherein, for each of said first exterior shelf structure and said second exterior shelf structure, said second surface of said shelf inner wall comprises at least one tab extending outward therefrom, each tab having a lower tab shoulder and a lower tab portion, said lower tab portion having an inner tab surface and extending below said lower tab shoulder and said lower surface of said shelf base, said first container sidewall comprises at least one tab aperture being defined in part by a lower edge, said tab of said first exterior shelf structure being received through said tab aperture, said lower tab portion extending below said lower edge of said tab aperture, said lower edge of said tab aperture and said lower tab shoulder abutting each other, and said inner tab surface and a portion of an inner surface of said first container sidewall abutting each other, and said second container sidewall comprises at least one tab aperture being defined in part by a lower edge, said tab of said second exterior shelf structure being received through said tab aperture, said lower tab portion extending below said lower edge of said tab aperture, said lower edge of said tab aperture and said lower tab shoulder abutting each other, and said inner tab surface and a portion of an inner surface of said second container sidewall abutting each other.

6. The container assembly of claim 5 wherein, said first exterior shelf structure and said second exterior shelf structure each comprise two of said tabs, said tabs being laterally spaced from each other, and said first container sidewall and said second container sidewall each comprise two tab apertures, said tab apertures being spaced apart and positioned so as to receive one tab therein.

7. The container assembly of claim 1 wherein for each of said first exterior shelf structure and said second exterior shelf structure, said forward shelf portion has a first extension extending upwardly from an upper surface of said forward shelf portion, said first extension having an aperture extending there-through and a second surface, and said rear shelf portion has a second extension extending upwardly from an upper surface of said rear shelf portion, said second extension having an aperture extending there-through and a second surface, further wherein, for said first exterior shelf structure, said second surface of said first extension abuts said exterior surface of said first container sidewall, and said aperture of said first extension is aligned with a first aperture in said first container sidewall, a first fastener being received through said aperture of said first extension and said first aperture of said first container sidewall, and said second surface of said second extension abuts said exterior surface of said first container sidewall, and said aperture of said second extension is aligned with a second aperture in said first container sidewall, a second fastener being received through said aperture of said second extension and said second aperture of said first container sidewall, for said second exterior shelf structure, said second surface of said first extension abuts said exterior surface of said second container sidewall, and said aperture of said first extension is aligned with a first aperture in said second container sidewall, a first fastener being received through said aperture of said first extension and said first aperture in said second container sidewall, and said second surface of said second extension abuts said exterior surface of said second container sidewall, and said aperture of said second extension is aligned with a second aperture in said second container sidewall, a second fastener being received through said aperture of said second extension and said second aperture of said second container sidewall.

8. The container assembly of claim 7 wherein said first container sidewall and said second container sidewall each comprise a container sidewall upper portion and a container sidewall lower portion, said container sidewall upper portion extending outward relative to said container sidewall lower portion and defining an overhang having an exterior lower surface, a portion of said upper surface of said forward shelf portion of said first exterior shelf structure abutting a portion of said exterior lower surface of said overhang of said first container sidewall, and a portion of said upper surface of said rear shelf portion of said first exterior shelf structure abutting a portion of said exterior lower surface of said overhang of said first container sidewall, and a portion of said upper surface of said forward shelf portion of said second exterior shelf structure abutting a portion of said exterior lower surface of said overhang of said second container sidewall, and a portion of said upper surface of said rear shelf portion of said second exterior shelf structure abutting a portion of said exterior lower surface of said overhang of said second container sidewall.

9. The container assembly of claim 8 wherein, an upper edge of said shelf inner wall of said first exterior shelf structure abuts a portion of said lower surface of said overhang of said first container sidewall, and an upper edge of said shelf inner wall of said second exterior shelf structure abuts a portion of said lower surface of said overhang of said second container sidewall.

10. The container assembly of claim 7 wherein, for each of said first exterior shelf structure and said second exterior shelf structure, said second surface of said shelf inner wall comprises at least one tab extending outward therefrom, each tab having a lower shoulder and a lower tab portion, said lower tab portion having an inner tab surface and extending below said lower tab shoulder and said lower surface of said shelf base, said first container sidewall comprises at least one tab aperture being defined in part by a lower edge, said tab of said first exterior shelf structure being received through said tab aperture, said lower tab portion extending below said lower edge of said tab aperture, said lower edge of said tab aperture and said lower tab shoulder abutting each other, and said inner tab surface and a portion of an inner surface of said first container sidewall abutting each other, and said second container sidewall comprises at least one tab aperture being defined in part by a lower edge, said tab of said second exterior shelf structure being received through said tab aperture, said lower tab portion extending below said lower edge of said tab aperture, said lower edge of said tab aperture and said lower tab shoulder abutting each other, and said inner tab surface and a portion of an inner surface of said second container sidewall abutting each other.

11. The container assembly of claim 10 wherein, said first exterior shelf structure and said second exterior shelf structure each comprise two of said tabs, said tabs being laterally spaced from each other, and said first container sidewall and said second container sidewall each comprise two tab apertures, said tab apertures being spaced apart and positioned so as to receive one tab therein.

12. The container assembly of claim 4 wherein said container body, said first exterior shelf structure, and said second exterior shelf structure each being independently fabricated from a plastic material selected independently from the group consisting of thermoset plastic materials, thermoplastic materials and combinations thereof.

13. The container assembly of claim 12 wherein said plastic material is a thermoplastic material selected independently from the group consisting of thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polyolefins, thermoplastic (meth)acrylates, thermoplastic acrylonitrile-butadiene-styrene, thermoplastic styrene-acrylonitrile, thermoplastic acrylonitrile-stryrene-acrylate and combinations thereof.

14. The container assembly of claim 1 wherein said container further comprises a closable lid that reversibly closes said open container top.

15. The container assembly of claim 1 wherein said first exterior shelf structure and said second exterior shelf structure each further comprise a closeable shelf lid that reversibly closes said shelf space, said closeable shelf lid having a first edge that is hingedly attached to said shelf inner wall.

16. The container assembly of claim 15 wherein said first exterior shelf structure and said second exterior shelf structure each further comprise an outer shelf wall having an upper edge, said upper edge of said outer shelf wall having a vertical height that is less than a vertical height of an upper edge of said inner shelf wall, and said closeable shelf lid having a second edge that abuts said upper edge of said outer shelf wall.

17. The container assembly of claim 1 wherein said first container sidewall, said second container sidewall, said front container wall and said rear container wall each have an upper wall portion and a lower wall portion, in each case said upper wall portion extending outward relative to said lower wall portion and together defining a container overhang extending substantially entirely around said container body and having an exterior lower surface and an interior upper surface residing within said container interior, said container assembly further comprising an interior container comprising a base having an upper surface and a lower surface, a sidewall structure extending upwardly from said base of said interior container and defining an open top thereof, and an upper lip extending laterally outward from an upper portion of said sidewall structure, at least a portion of a lower surface of said upper lip abutting at least a portion of said interior upper surface of said container overhang, thereby suspending said lower surface of said base of said interior container above an upper surface of said base of said container body.

* * * * *